US008403454B2

(12) United States Patent
Kitamura et al.

(10) Patent No.: US 8,403,454 B2
(45) Date of Patent: Mar. 26, 2013

(54) LIQUID EJECTING APPARATUS

(75) Inventors: Kenichi Kitamura, Shiojiri (JP); Yasushi Yajima, Minowa-machi (JP); Norihito Harada, Azumino (JP); Daisuke Hiruma, Matsumoto (JP); Ryo Hamano, Matsumoto (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 75 days.

(21) Appl. No.: 13/178,425

(22) Filed: Jul. 7, 2011

(65) Prior Publication Data

US 2012/0013680 A1 Jan. 19, 2012

(30) Foreign Application Priority Data

Jul. 14, 2010 (JP) ..... 2010-159680
Sep. 3, 2010 (JP) ..... 2010-197836

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS 6,679,578 B2 * 1/2004 Arakawa ..... 347/33
2009/0085961 A1 * 4/2009 Shimazaki ..... 347/29

FOREIGN PATENT DOCUMENTS

JP 2008273109 11/2008

* cited by examiner

*Primary Examiner* — Matthew Luu
*Assistant Examiner* — Alejandro Valencia
(74) *Attorney, Agent, or Firm* — Workman Nydegger

(57) ABSTRACT

At a front-end side opposite to a head-fixing-member-attachment side, a protection member has an inclined plane sloped up from a head side toward the opposite outer side in a direction in which liquid ejecting heads are arranged in a row. The surface of the front end is located at a position that is not closer to a head-fixing member in comparison with the nozzle surface of each of the liquid ejecting heads attached to the head-fixing member or level therewith. A recess is formed at a part of the inclined plane. In a state in which one of the caps faces the protection member and, in addition, each of the remaining caps is in contact with the nozzle surface of the liquid ejecting head, a part of the cap facing the protection member is in the recess, which ensures that the cap is not in contact with the protection member.

3 Claims, 16 Drawing Sheets

LIQUID EJECTING APPARATUS

The entire disclosure of Japanese Patent Application No: 2010-159680, filed Jul. 14, 2010 and Japanese Patent Application No: 2010-197836, filed Sep. 3, 2010 are expressly incorporated by reference herein.

BACKGROUND

1. Technical Field

The present invention relates to a liquid ejecting apparatus that is equipped with a plurality of liquid ejecting heads for ejecting liquid retained in pressure chambers through nozzles by applying a pressure change in the pressure chambers, which are in communication with the nozzles.

2. Related Art

A liquid ejecting apparatus is a machine that is provided with a liquid ejecting head that can eject (discharge) liquid. Having such a liquid ejecting head, a liquid ejecting apparatus is capable of ejecting various kinds of liquid. An example of a liquid ejecting apparatus is an image recording apparatus such as an ink-jet printer. An ink-jet printer is provided with an ink-jet recording head, which is an example of various kinds of a liquid ejecting head. An ink-jet printer performs recording by ejecting ink in the form of ink droplets from nozzles of an ink-jet recording head toward a recording target medium such as a sheet of printing paper. As a result of the landing of discharged ink droplets on the surface of a recording target medium, dots are formed thereon. In this way, an ink-jet printer records an image and the like on a recording target medium. An ink-jet recording head is hereinafter simply referred to as a "recording head". An ink-jet printer is hereinafter simply referred to as a "printer". These days, the application of such a liquid ejecting apparatus is not limited to an image recording apparatus mentioned above. It is applied to various manufacturing apparatuses. For example, in a display manufacturing apparatus for the production of liquid crystal displays, plasma displays, organic electroluminescence (EL) displays, surface/plane emission displays (FED), or the like, a liquid ejecting apparatus is used as a machine for ejecting various liquid materials such as colorants and electrode materials onto a pixel formation area, an electrode formation area, and the like.

Some recent printers are equipped with a single head unit that has the following structure: a plurality of recording heads is fixed to a head-fixing member such as a sub carriage in a row; each of the plurality of recording heads has a nozzle group that is made up of a plurality of nozzles formed in rows. Some of them are equipped with a capping mechanism that includes a plurality of caps arranged in a row corresponding to the head row (for example, refer to JP-A-2008-273109). Each cap is, for example, is a tray-like member that is made of an elastic material such as elastomer. The top (facing the nozzle formation surface of the corresponding recording head) of the cap is open. When the printer is in a pause state in which a recording head is not used for printing an image and the like on a recording target medium or when operation for forcibly sucking ink, air bubbles, and the like out of the nozzles of a recording head is performed, the capping mechanism brings the top of sidewalls of a cap into contact with the nozzle formation surface of a recording head for sealing (capping). An inner space of the cap that is formed when the cap is in contact with the nozzle formation surface (hereinafter referred to as "sealed space") is in communication with a waste liquid tank through a waste liquid tube and a suction pump. The suction pump is driven to apply a negative pressure to the sealed space through the waste liquid tube. Due to the negative pressure, ink, air bubbles, and the like are discharged into the sealed space through nozzles. The ink, etc, discharged into the sealed space is drained to the waste liquid tank through the waste liquid tube.

A printer that has a protecting projection formed on a sub carriage has been proposed in the art. The protecting projection is provided for protecting a side and the nozzle formation surface of a recording head. The protecting projection is provided at an end in a direction in which a plurality of recording heads attached to a carriage is arranged in a row. The protecting projection protrudes downward, that is, toward a recording target medium during recording operation, in parallel with a side of a recording head. The front end of the protecting projection is located at the same height as the nozzle formation surface of each of the plurality of recording heads or below the surface. Since such a protecting projection is provided, it is possible to prevent recording paper or the like from coming into contact with a recording head when ink is ejected from the recording head onto the recording paper to print an image and the like thereon.

In such a printer, if each of a plurality of caps corresponding to a plurality of recording heads has a function for sucking ink, the structure of the printer is complex, which results in an increase in cost. To avoid an increase in cost, a printer that has a structure in which not all but some of caps corresponding to a plurality of recording heads have a function for sucking ink has now been being developed in the art. In such a structure, either the group of recording heads or the group of caps is moved relative to the other in a direction in which the recording heads are arranged in a row. By this means, a cap that has the ink-sucking function is brought into contact with a suction target head. With such a structure, it is possible to perform suction operation for all of the recording heads even though it is only some of the caps that have the ink-sucking function. However, such a printer has the following disadvantages. When capping operation is performed in a state in which any cap faces the protecting projection, the collision of the cap and the protecting projection sometimes occurs. In such a case, there is a risk of the sticking of ink from the cap onto the protecting projection. In addition, there is a risk of the dripping of the transferred ink from the protecting projection onto recording paper during printing.

SUMMARY

An advantage of some aspects of the invention is to provide a liquid ejecting apparatus that can protect a liquid ejecting head and makes it possible to shift a relative position of a cap group and liquid ejecting heads in parallel with respect to a direction in which the liquid ejecting heads are arranged in a row.

A liquid ejecting apparatus according to an aspect of the invention includes a liquid ejecting head unit, a protection member, and a cap group. The liquid ejecting head unit includes a head-fixing member to which a plurality of liquid ejecting heads is attached in a row. Each of the plurality of liquid ejecting heads has a nozzle surface and is capable of ejecting liquid toward a liquid ejection target medium from nozzles that are formed in the nozzle surface. The protection member is located outside the row of the liquid ejecting heads adjacent to a liquid ejecting head included in the liquid ejecting heads. This liquid ejecting head is located at an end in a direction in which the liquid ejecting heads are arranged in the row, the direction being hereinafter referred to as side-by-side-arrangement direction. The protection member is provided thereat for protecting a side of the adjacent liquid ejecting head. The cap group is made up of a plurality of caps for covering the nozzles. The number of the caps is the same as that of the liquid ejecting heads of the liquid ejecting head unit. The caps are arranged in the side-by-side-arrangement direction with the same gap each therebetween as the gap of the liquid ejecting heads each therebetween. A relative position of the cap group and the liquid ejecting heads of the liquid ejecting head unit can be shifted in parallel with respect to the side-by-side-arrangement direction. A state of the cap group can be changed into a state in which a cap included in the cap group is in contact with the nozzle surface. The protection member has an inclined plane at a front-end portion. The inclined plane is sloped up from a liquid-ejecting-head side toward the opposite side, that is, outward, with respect to the side-by-side-arrangement direction. A recess is formed at a part of the inclined plane. In a state in which one of the caps faces the protection member and, in addition, each of the remaining caps is in contact with the nozzle surface of a liquid ejecting head, a part of the cap facing the protection member is in the recess, which ensures that the cap is not in contact with the protection member.

With such a structure, when the apparatus is put into a state in which one of the caps faces the protection member and, in addition, each of the remaining caps is in contact with the nozzle surface of a liquid ejecting head, a part of the cap facing the protection member is allowed to escape into the recess in a contact-avoiding manner. Thus, the collision/contact of the cap with the protection member does not occur. Thus, the sticking of liquid from the cap onto the protection member does not occur. Moreover, since the protection member has the inclined plane, when a liquid ejection target medium that is transported toward the liquid ejecting head unit from a side in the side-by-side-arrangement direction collides with the inclined plane, the protection member can guide the liquid ejection target medium away from the head-fixing member along its inclined plane, thereby lessening the impact of the collision. That is, in addition to its structure for avoiding contact with a cap at the time of capping operation, the protection member has a function of protecting the liquid ejecting head. Since the protection member has a contact-avoiding function, a structure in which a sucking means is provided in at least one cap in the cap group and suction operation is performed for all of the liquid ejecting heads attached to the head-fixing member sequentially through the relative movement of the liquid ejecting heads and the cap group can be adopted. That is, it is not necessary to provide the sucking means as an individual sucking device for each of caps making up the cap group, thereby offering a simplified structure.

In the above structure, it is preferable that the recess should include a first recess inclined plane that is steeper than the inclined plane with respect to a plane that is parallel with the nozzle surface and a second recess inclined plane that is gentler than the inclined plane with respect to the plane that is parallel with the nozzle surface.

With such a preferred structure, even when a liquid ejection target medium gets into the recess, the protection member can exert its function of guiding the liquid ejection target medium downward. More specifically, the protection member can guide the liquid ejection target medium downward along the second recess inclined plane and the first recess inclined plane. Therefore, it is possible to lessen the impact of collision that occurs when the liquid ejection target medium gets into the recess.

Preferably, a liquid ejecting apparatus according to the above aspect of the invention should further include a sucking section, wherein at least one of the plurality of caps that make up the cap group can suck liquid out of the nozzles formed in the nozzle surface by using a suction force of the sucking section in a state in which the at least one cap is in contact with the nozzle surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, exemplary embodiments of the present invention will now be explained in detail. Although various specific features are explained in the following exemplary embodiments of the invention for the purpose of disclosing preferred modes thereof, the scope of the invention is not limited to the specific embodiments described below unless any intention of restriction is explicitly shown. In the following description, an ink-jet recording apparatus is taken as an example of a liquid ejecting apparatus according to an aspect of the invention. The ink-jet recording apparatus is hereinafter simply referred to as a "printer".

Figure 1:
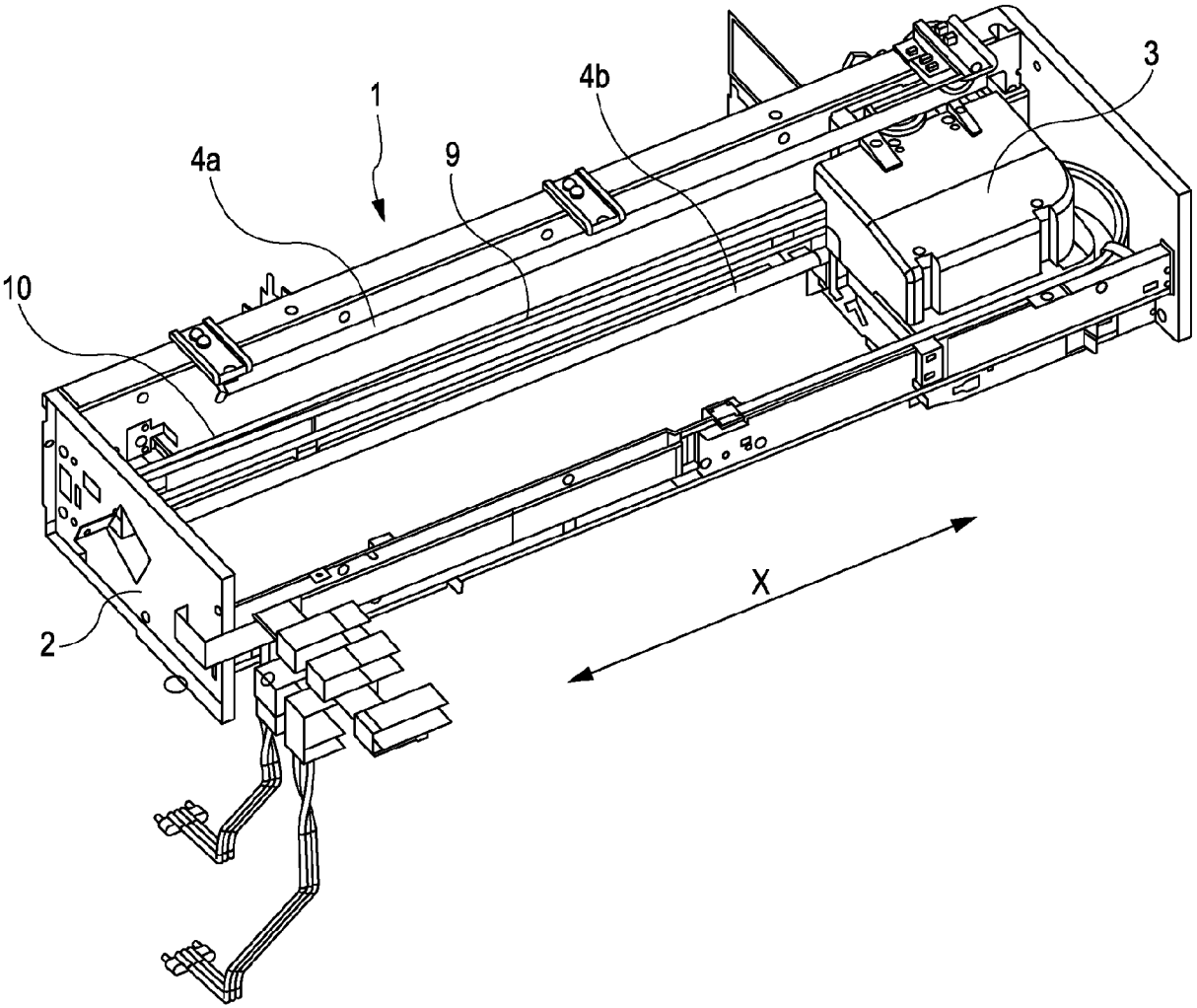
FIG. 1 is a perspective view that schematically illustrates an example of a part of the inner structure of a printer according to an exemplary embodiment of the invention.
Figure 2:
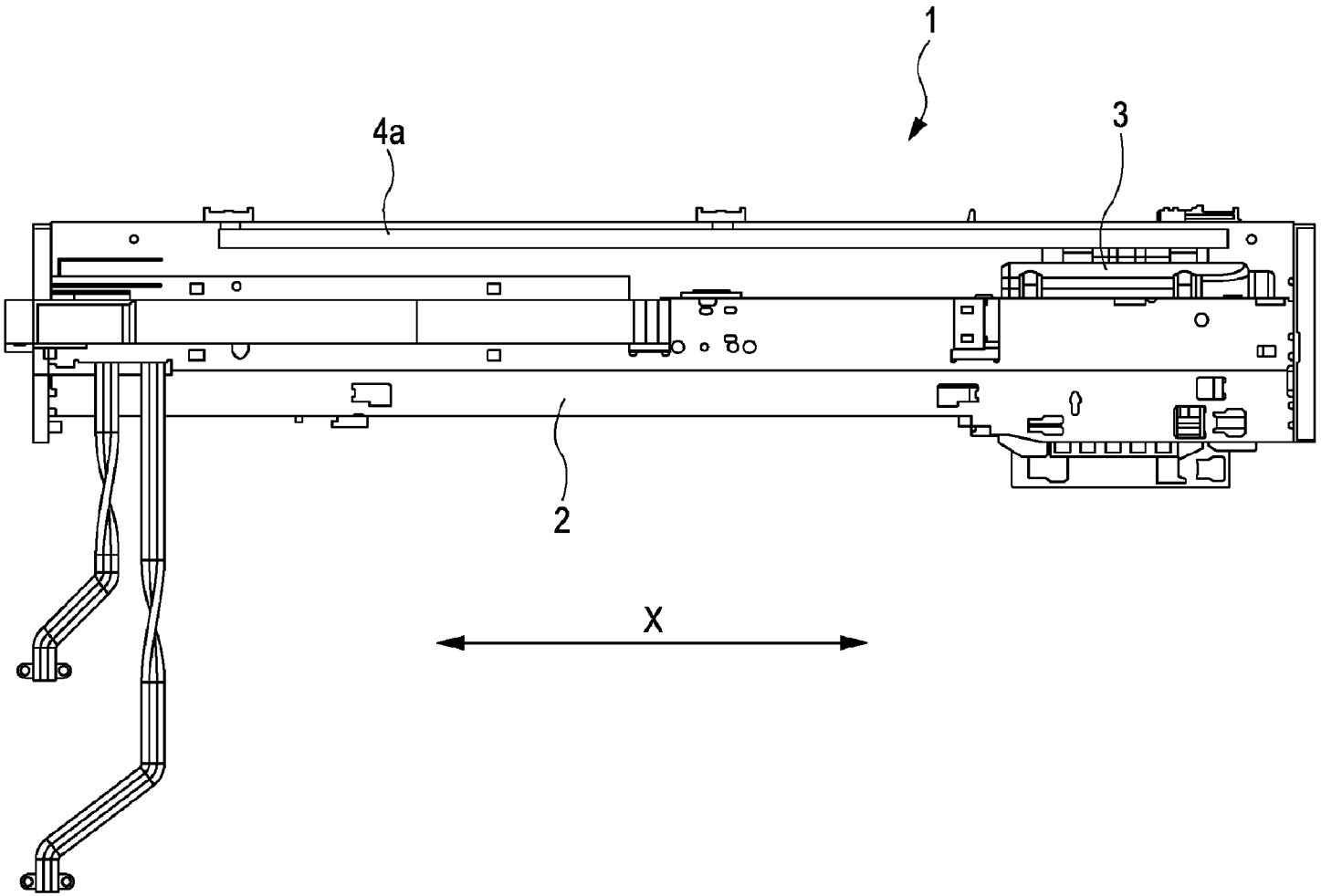
FIG. 2 is a front view of the printer.
Figure 3:
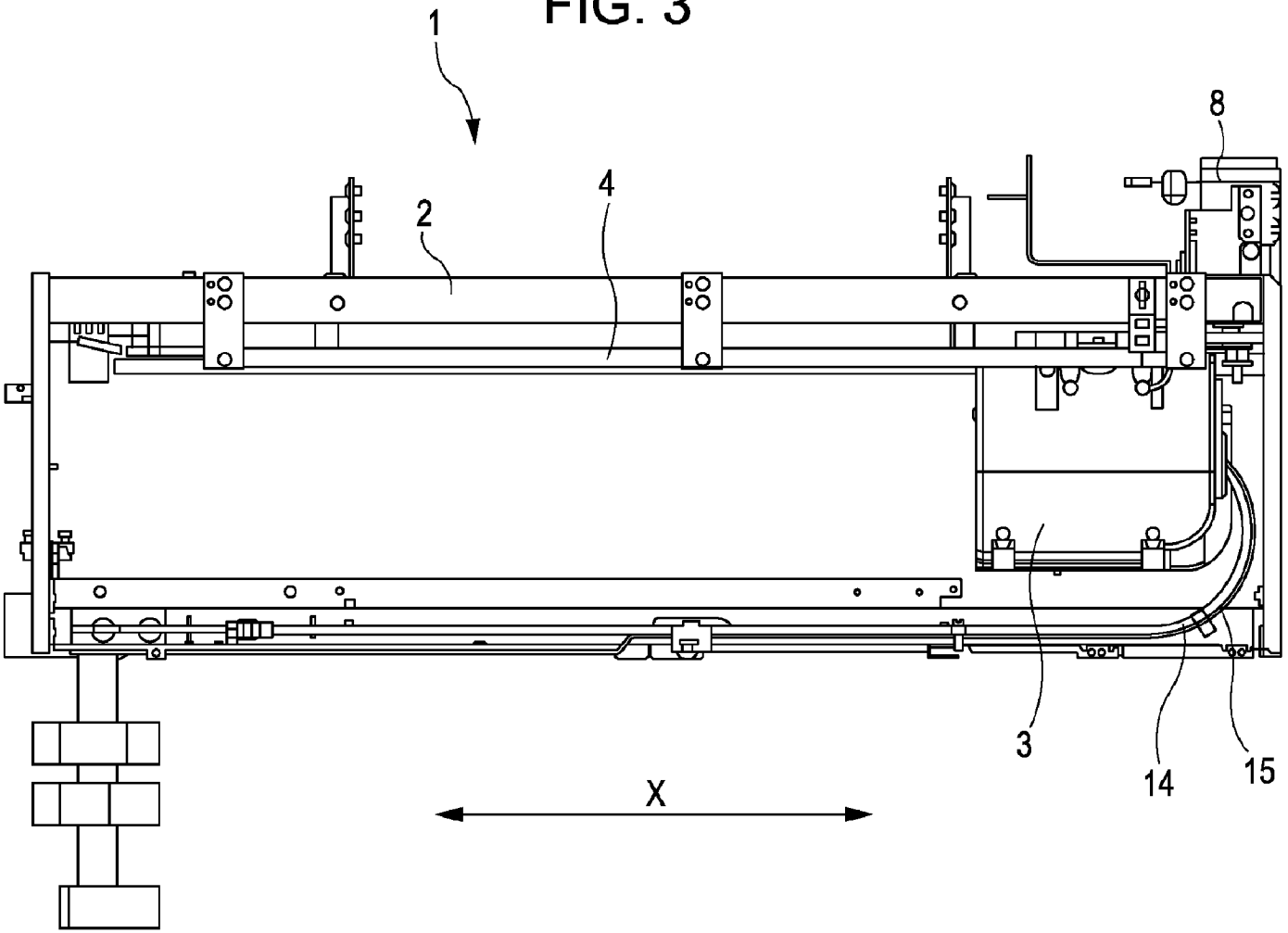
FIG. 3 is a plan view of the printer.
Figure 4:
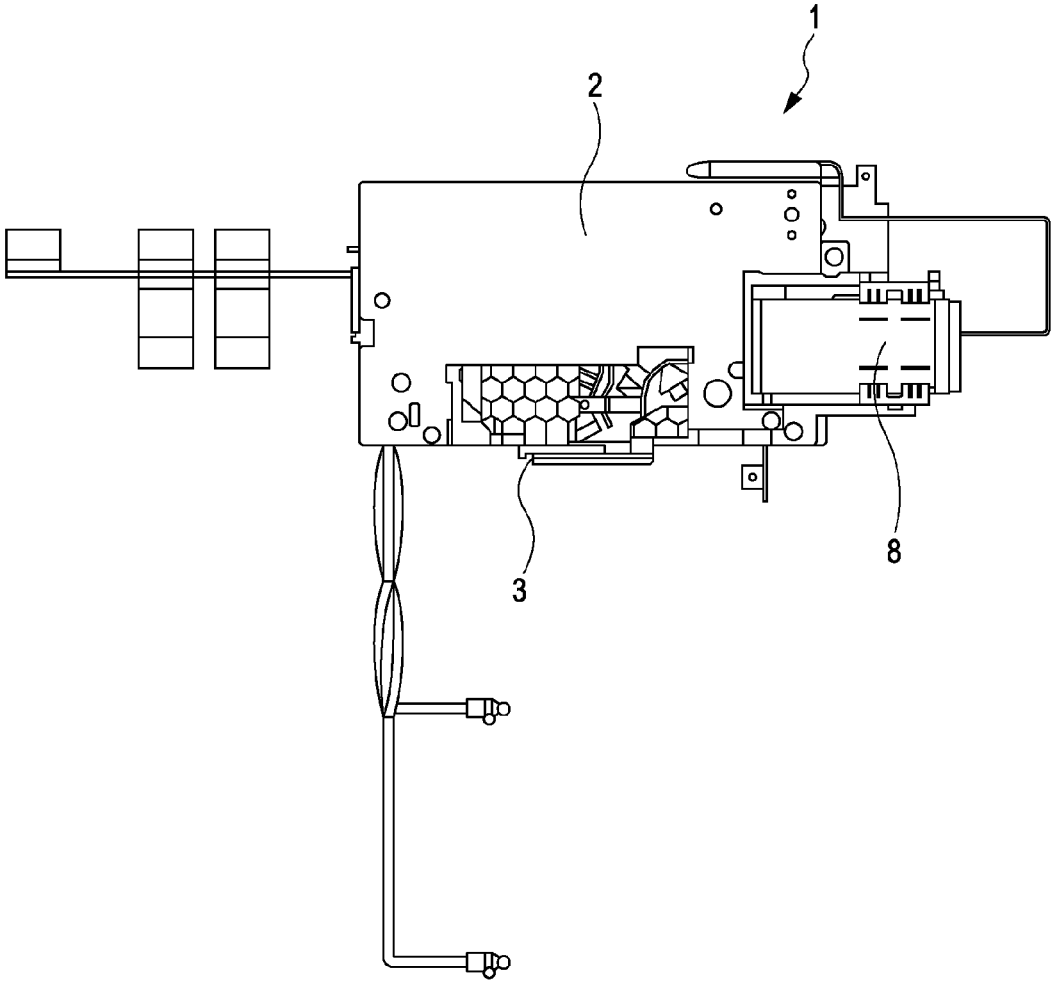
FIG. 4 is a right side view of the printer.

FIG. 1 is a perspective view that schematically illustrates an example of a part of the inner structure of a printer 1. FIG. 2 is a front view of the printer 1. FIG. 3 is a plan view of the printer 1. FIG. 4 is a right side view of the printer 1. The printer 1 illustrated in these drawings ejects ink, which is a kind of liquid, toward a recording target medium such as a sheet of recording paper, cloth, film, or the like (not shown). The recording target medium is a kind of a liquid ejection target medium according to an aspect of the invention, which is, for example, an object on which ink droplets discharged from a print head will land. The printer 1 has a frame 2. A carriage assembly 3, which is a kind of a head-unit holding member, is provided inside the frame 2. The carriage assembly 3 can reciprocate in a main scan direction, which is orthogonal to a direction in which a recording target medium is transported. The main scan direction is denoted as X in the accompanying drawings including FIG. 1. A pair of elongated upper and lower guide rods 4*a* and 4*b* is supported along the inside of the rear wall of the frame 2 of the printer 1 in the direction of the length of the frame 2. The guide rods 4*a* and 4*b* are supported in parallel with each other with a predetermined clearance therebetween. The guide rod 4 is inserted through a bearing cavity 7 (refer to FIG. 7), etc., which is formed at the back of the carriage assembly 3. With such a structure, the carriage assembly 3 can slide along the guide rod 4 in a supported state.

A carriage motor 8 is provided at the rear of the frame 2 at one end in the main scan direction X (right end in FIG. 3). The carriage motor 8 is a driving source that supplies power to move the carriage assembly 3. The driving shaft of the carriage motor 8 protrudes inward from the rear side of the frame 2. A driving pulley, which is not illustrated in the drawings, is provided at the tip of the shaft. The driving pulley rotates when driven by the carriage motor 8. A driven pulley, which is not illustrated in the drawings, is provided at the side opposite to the side of the driving pulley in the main scan direction X (left end in FIG. 3). A timing belt 9 is stretched between the driving pulley and the driven pulley. The carriage assembly 3 is attached to the timing belt 9. When the carriage motor 8 operates, the driving pulley rotates. The timing belt 9 turns due to the rotation of the driving pulley. As a result, the carriage assembly 3 moves along the guide rods 4*a* and 4*b* in the main scan direction X.

A linear scale (encoder film) 10 is provided on the inside of the rear wall of the frame 2 in parallel with the guide rods 4*a* and 4*b* along the main scan direction X. The linear scale 10 is a strip-shaped (band-like) member that is made of a transparent resin film. For example, the linear scale 10 has the following structure. A plurality of stripes that is not transparent is printed on the surface of a transparent base film. Each of the plurality of stripes extends in the direction of the width of the strip. The stripes have equal width. The stripes are printed at a constant pitch in the direction of the length of the strip. On the other hand, a linear encoder (not shown) is provided on the rear of the carriage assembly 3. The linear encoder optically reads the stripes of the linear scale 10. For example, the linear encoder is made up of a pair of a light-emitting element and a light-receiving element that are arranged opposite to each other. The linear encoder outputs an encoder pulse depending on a difference between the state of photo detection at each transparent part of the linear scale 10 and the state of photo detection at each stripe part thereof. That is, the linear encoder is a kind of a positional information outputting means. Functioning as such a means, the linear encoder outputs an encoder pulse corresponding to the scan position of the carriage assembly 3 as positional information in the main scan direction X. Therefore, the control unit (not shown) of the printer 1 can control the recording operation of a head unit 17 on a recording target medium while obtaining information on the scan position of the carriage assembly 3 on the basis of an encoder pulse supplied from the linear encoder. The printer 1 is configured to be able to perform so-called bidirectional recording processing. Specifically, the printer 1 can print characters, images, and the like on a sheet of recording paper both during the outward movement of the carriage assembly 3 and the homeward movement thereof. During its outward movement, the carriage assembly 3 travels from a home position, which is located at one end in the main scan direction X, to a full position, which is located at the other end in the main scan direction X. The home position is a position where the carriage assembly 3 is in a stationary state on standby when it is not being driven. During its homeward movement, the carriage assembly 3 travels from the full position back to the home position.

As illustrated in FIG. 3, an ink-supplying tube 14 and a signal cable 15 are connected to the carriage assembly 3. Ink having each of a plurality of colors is supplied through the ink-supplying tube 14 to the corresponding one of a plurality of recording heads 18 of the head unit 17. Signals such as a driving signal are supplied through the signal cable 15. A plurality of capping members each of which can seal the nozzle formation surface 53 of the recording head 18 is provided below the carriage assembly 3, more specifically, under the carriage assembly 3 when it is in a standby state at the home position. A more detailed explanation of the plurality of capping members will be given later. In addition to the components explained above, though not illustrated in the drawings, the printer 1 includes a cartridge attachment portion, to which ink cartridges (source for supplying liquid) containing ink can be detachably attached, a medium transportation unit, which transports recording paper, and the like.

Figure 5:
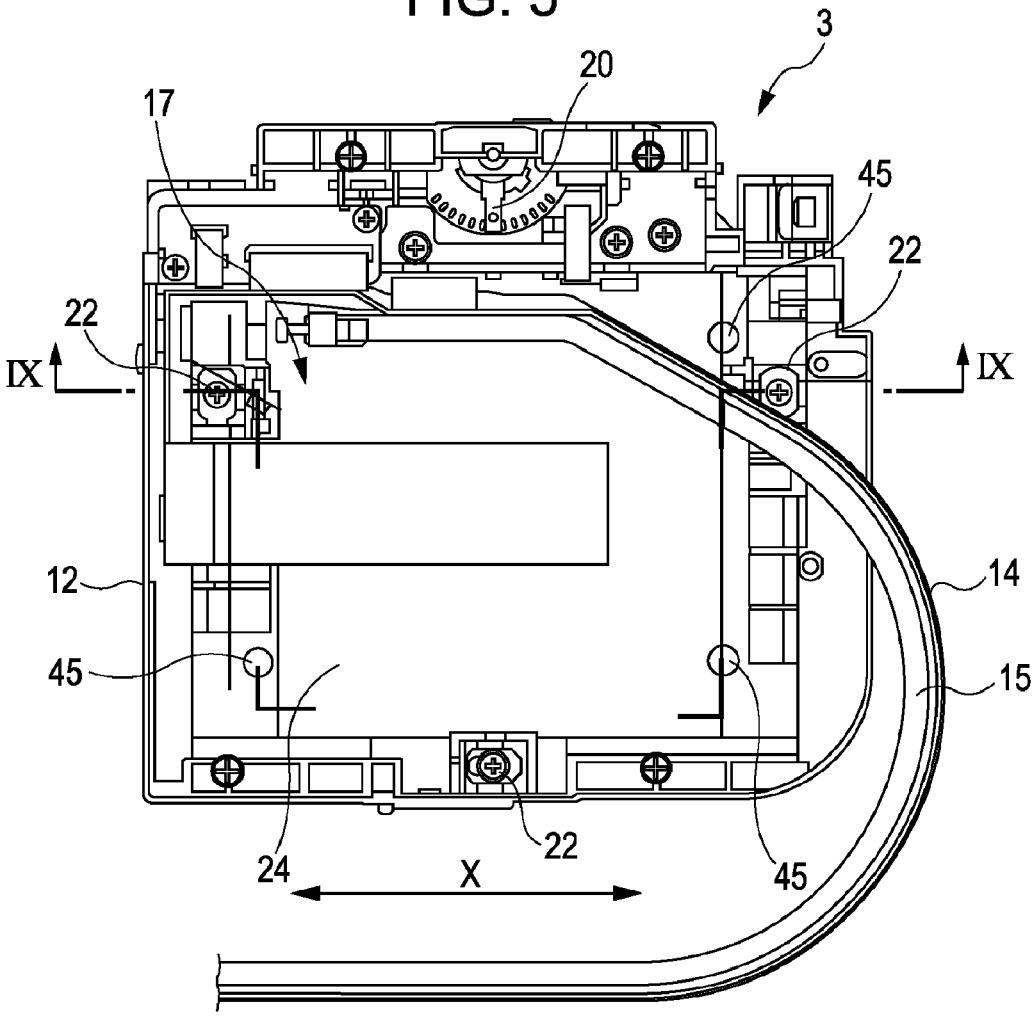
FIG. 5 is a plan view of a carriage assembly according to an exemplary embodiment of the invention.
Figure 6:
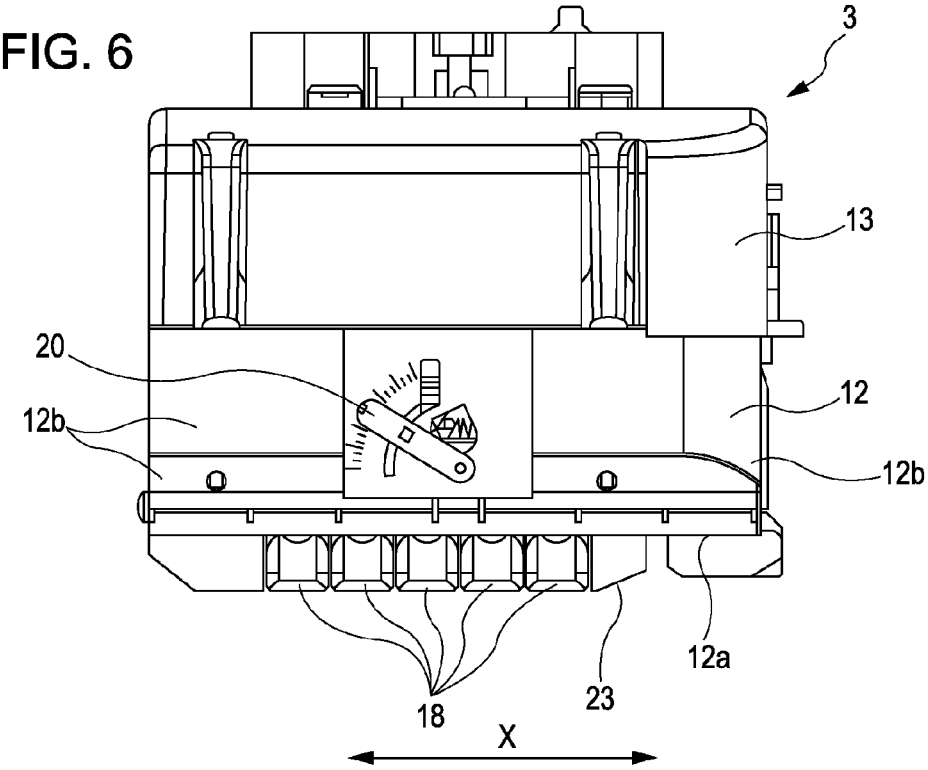
FIG. 6 is a front view of the carriage assembly.
Figure 7:
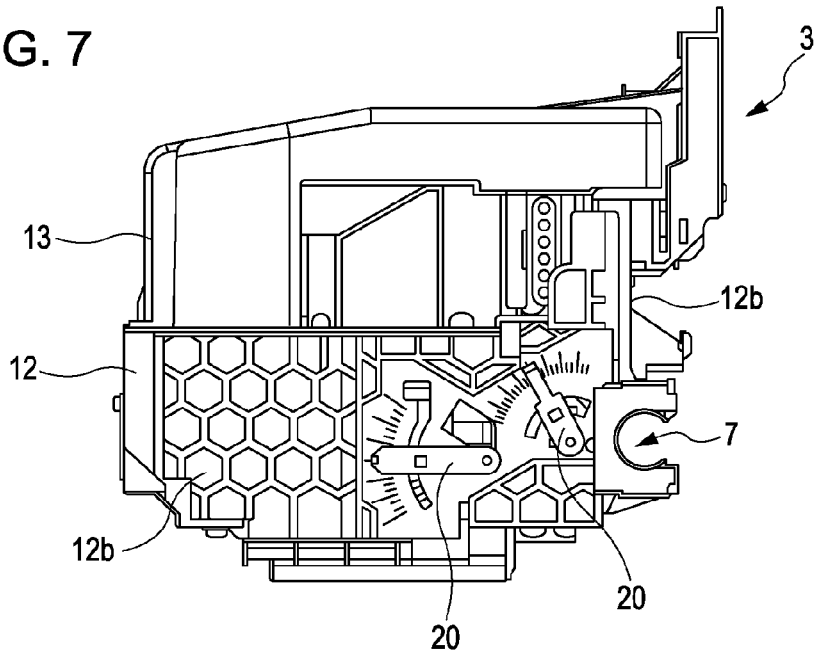
FIG. 7 is a right side view of the carriage assembly.
Figure 8:
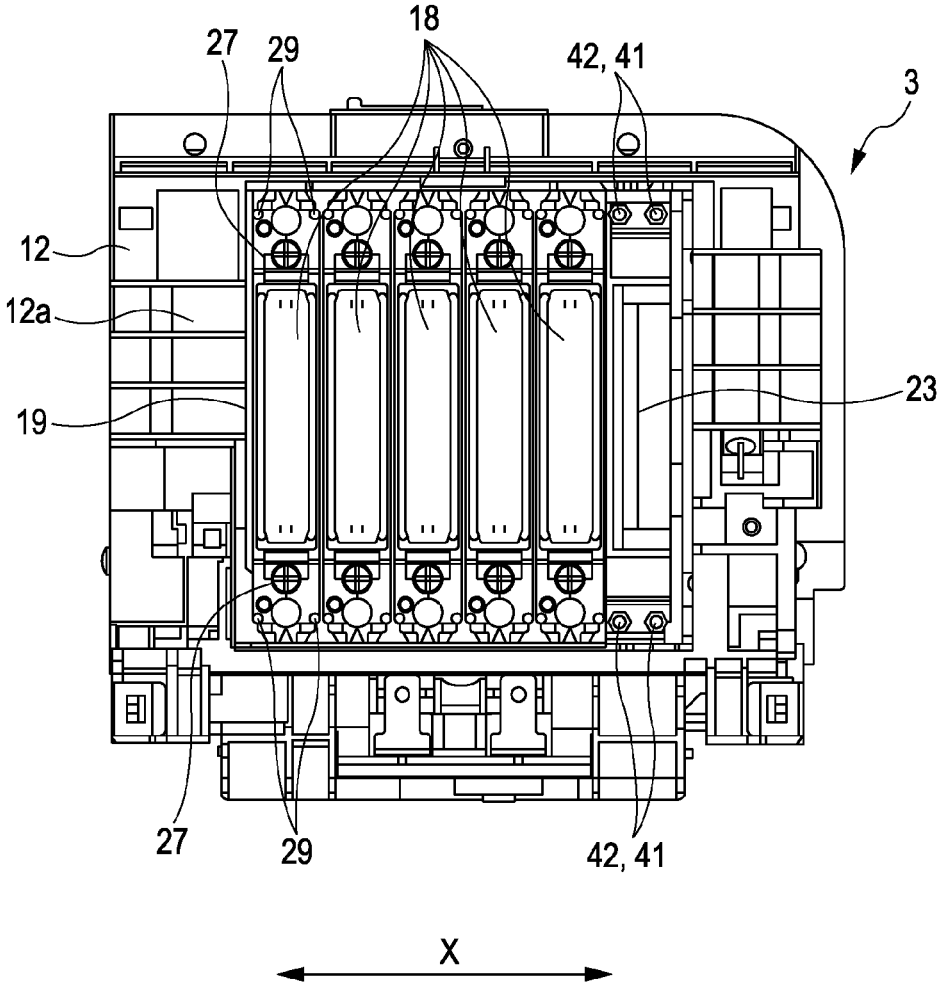
FIG. 8 is a bottom view of the carriage assembly.
Figure 9:
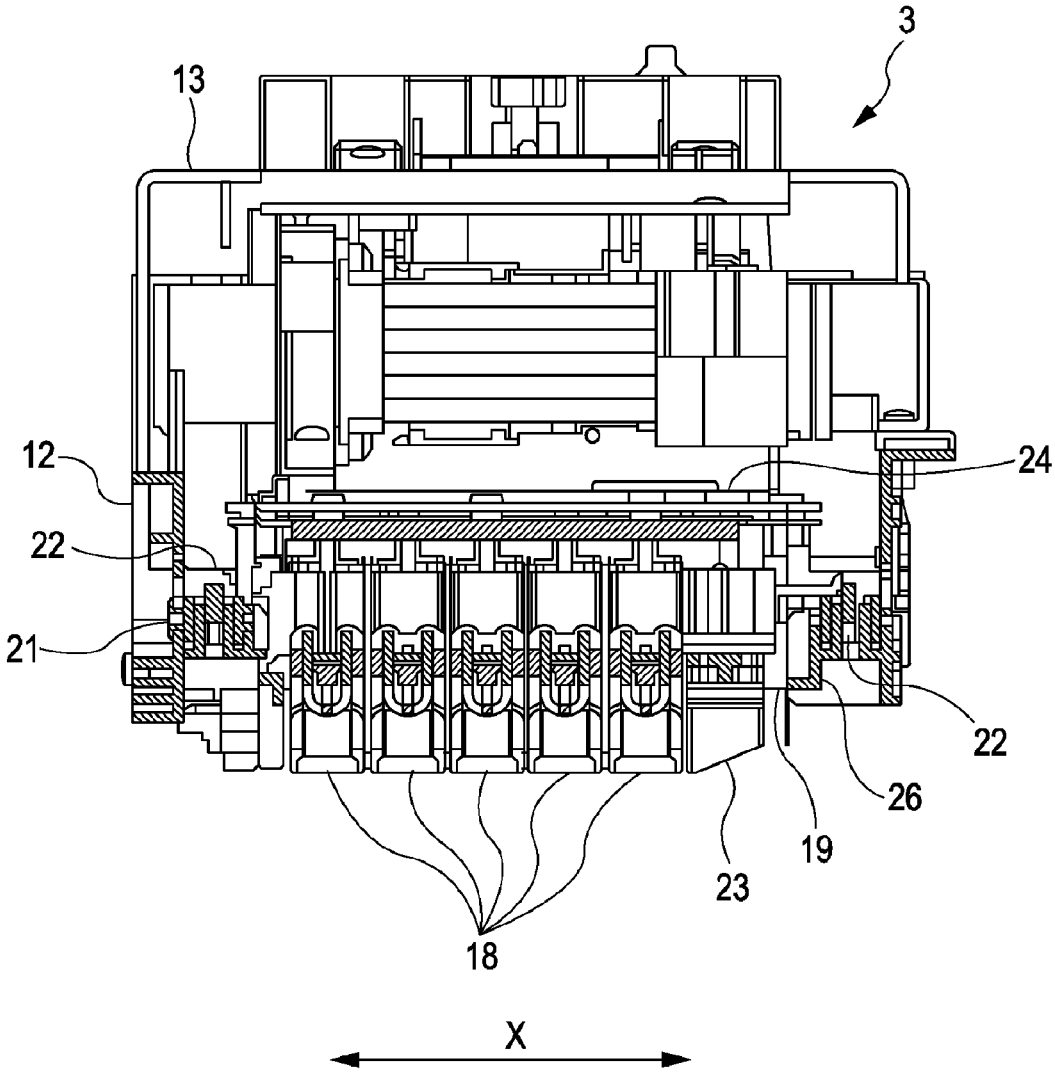
FIG. 9 is a sectional view taken along the line IX-IX of FIG. 5.

FIG. 5 is a plan view (top view) of the carriage assembly 3. FIG. 6 is a front view of the carriage assembly 3. FIG. 7 is a right side view of the carriage assembly 3. FIG. 8 is a bottom view of the carriage assembly 3. FIG. 9 is a sectional view taken along the line IX-IX of FIG. 5. Note that a state after the removal of a carriage cover 13 is illustrated in FIG. 5. The carriage assembly 3 is a hollow box-like member that is made up of two components, which are a carriage body 12 and the carriage cover 13, and can be separated into the lower component and the upper component. The head unit 17 is mounted inside the carriage body 12. The carriage body 12 has an opening at its top, which is usually covered by the carriage cover 13. A more detailed explanation of the head unit 17, which is an example of a liquid ejecting head unit according to an aspect of the invention, will be given later. The carriage body 12 includes a substantially rectangular bottom plate portion 12*a* and sidewall portions 12*b*. Each of the sidewall portions 12*b* rises perpendicularly from the corresponding one of the four sides of the bottom plate portion 12*a*. The head unit 17 is housed in a space enclosed by the bottom plate portion 12*a* and the sidewall portions 12*b*. As illustrated in FIG. 8, a bottom opening 19 is formed in the bottom plate portion 12*a* for the purpose of exposing the nozzle formation surface 53 (refer to FIG. 16) of each of the plurality of recording heads 18 of the head unit 17 housed in the space. In a state in which the head unit 17 is mounted inside the carriage body 12, each of the plurality of recording heads 18 protrudes partially through the bottom opening 19 of the bottom plate portion 12*a* in such a manner that its nozzle formation surface 53 is located under the bottom of the carriage body 12, in other words, protrudes toward (is located closer to) a recording target medium during recording operation.

A plurality of eccentric cams 21 (refer to FIGS. 9 and 15) is provided between the carriage body 12 and the head unit 17. The eccentric cams 21 are used for adjusting the relative position/inclination (hereinafter referred to as "mount state") of the head unit 17 mounted inside the carriage body 12. A plurality of levers 20 that is used for rotating these eccentric cams 21 is provided on the carriage body 12. The plurality of eccentric cams 21 rotates when these levers 20 are operated. When the eccentric cam 21 rotates, its height from the center of rotation to its circumferential surface fluctuates. It is possible to adjust the mount state of the head unit 17 housed in the space of the carriage body 12, such as the position of the head unit 17 and the inclination thereof, in relation to the carriage body 12 by utilizing the increase/decrease in the height of each of the plurality of eccentric cams 21.

Figure 10A:
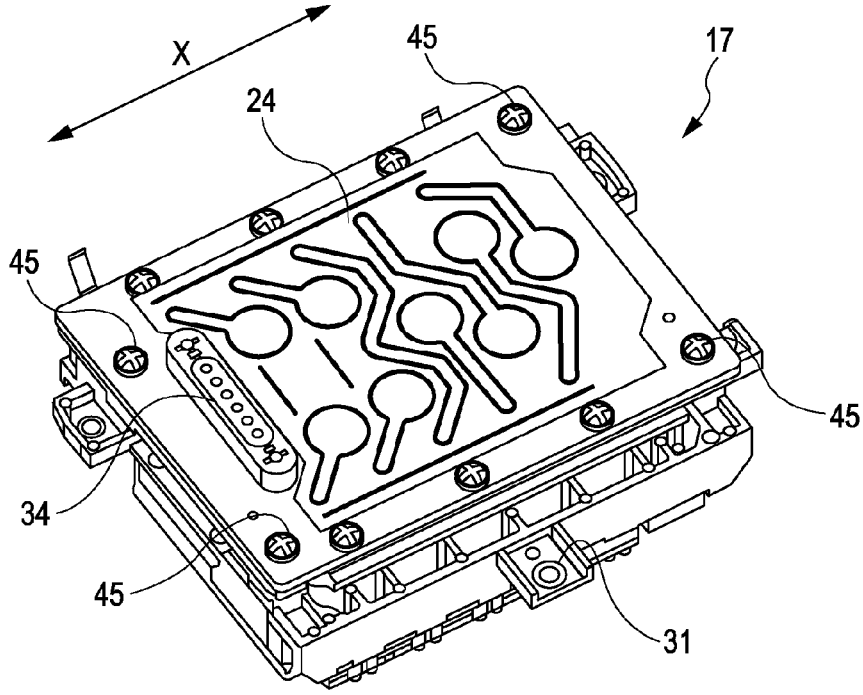
FIG. 10A is a perspective view of a head unit according to an exemplary embodiment of the invention.
Figure 10B:
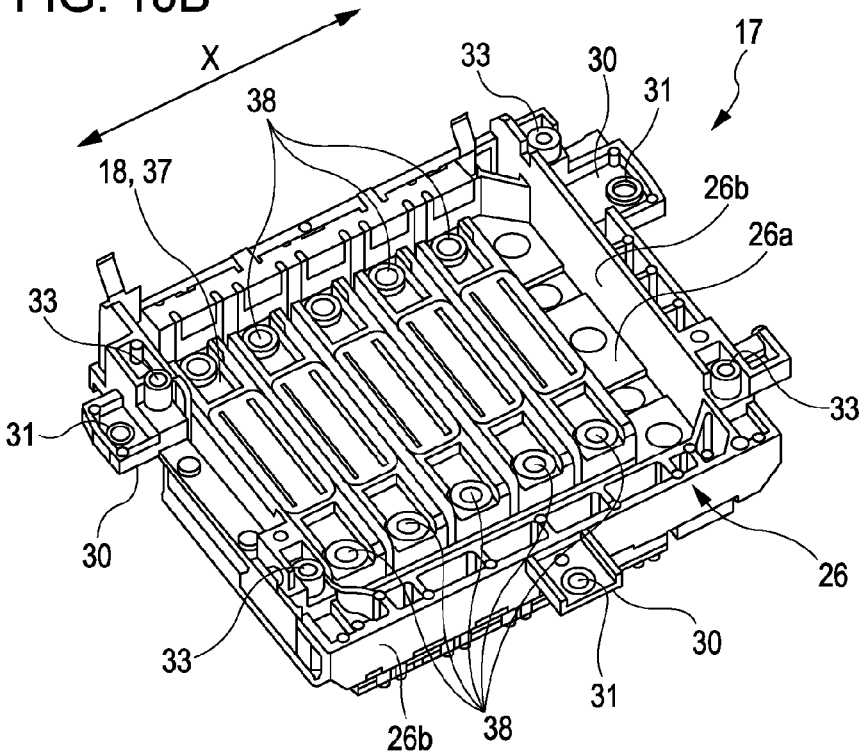
FIG. 10B is a perspective view of the head unit.
Figure 11:
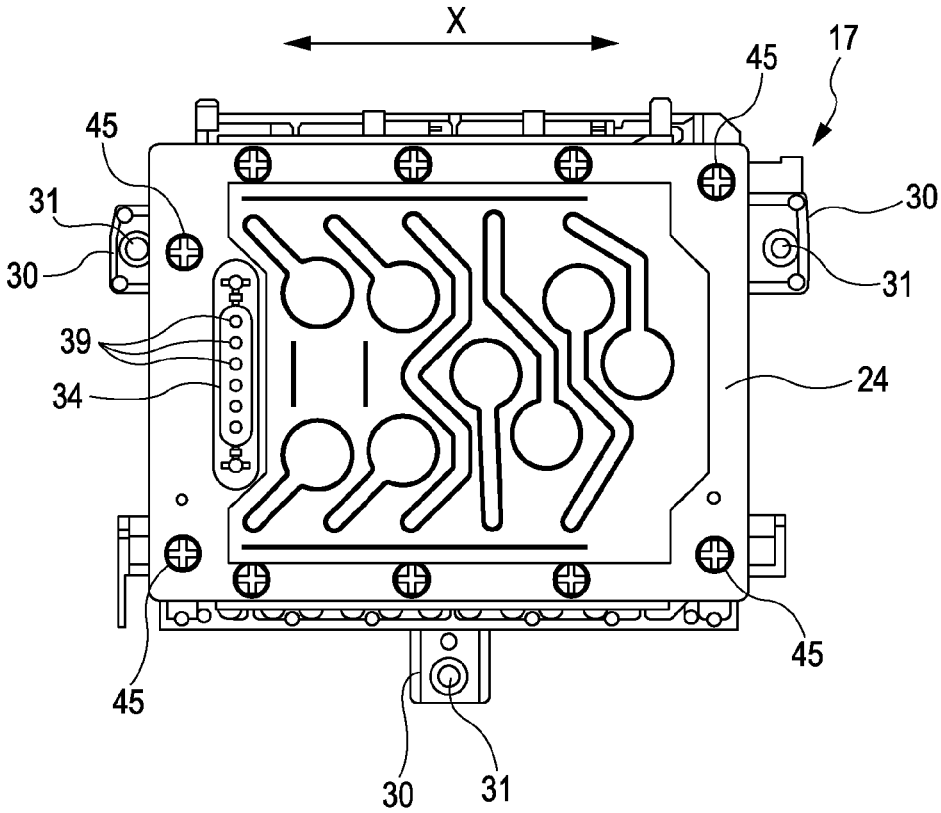
FIG. 11 is a plan view of the head unit.
Figure 12:
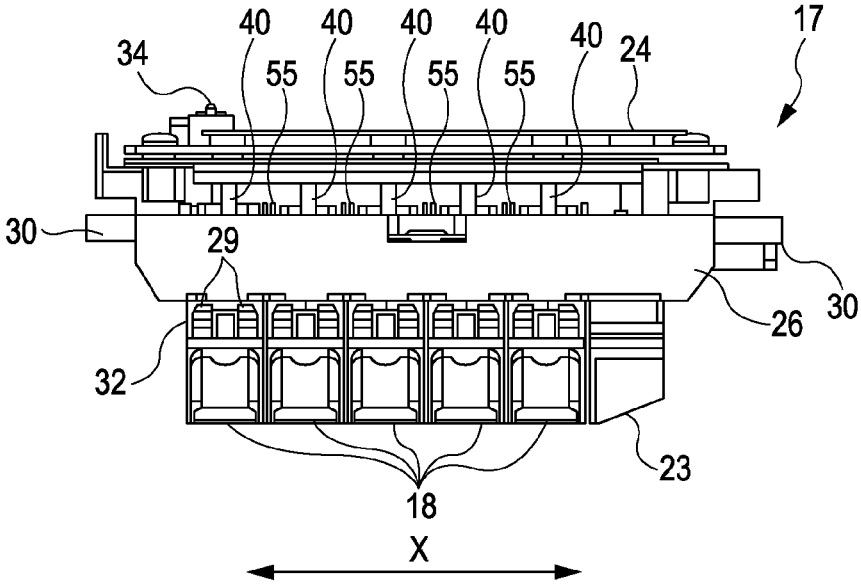
FIG. 12 is a front view of the head unit.
Figure 13:
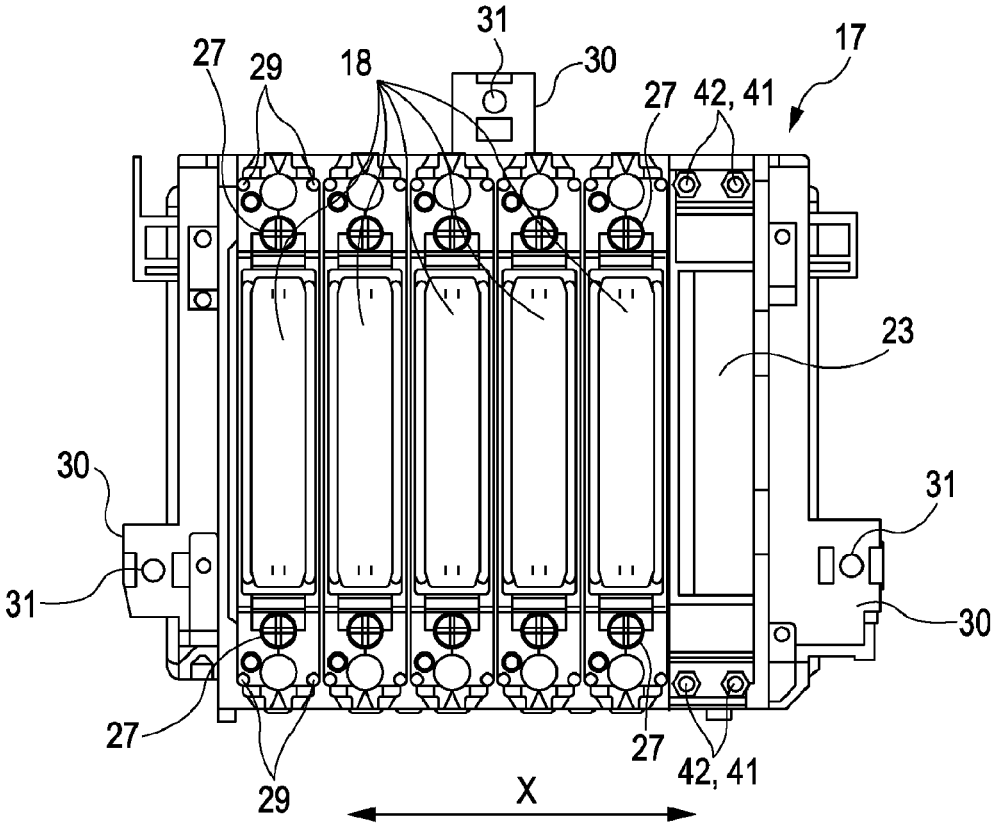
FIG. 13 is a bottom view of the head unit.
Figure 14:
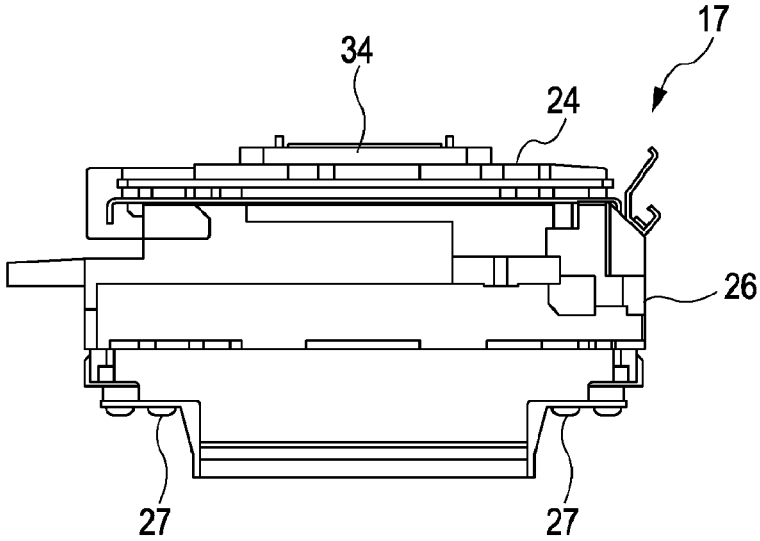
FIG. 14 is a right side view of the head unit.
Figure 15:
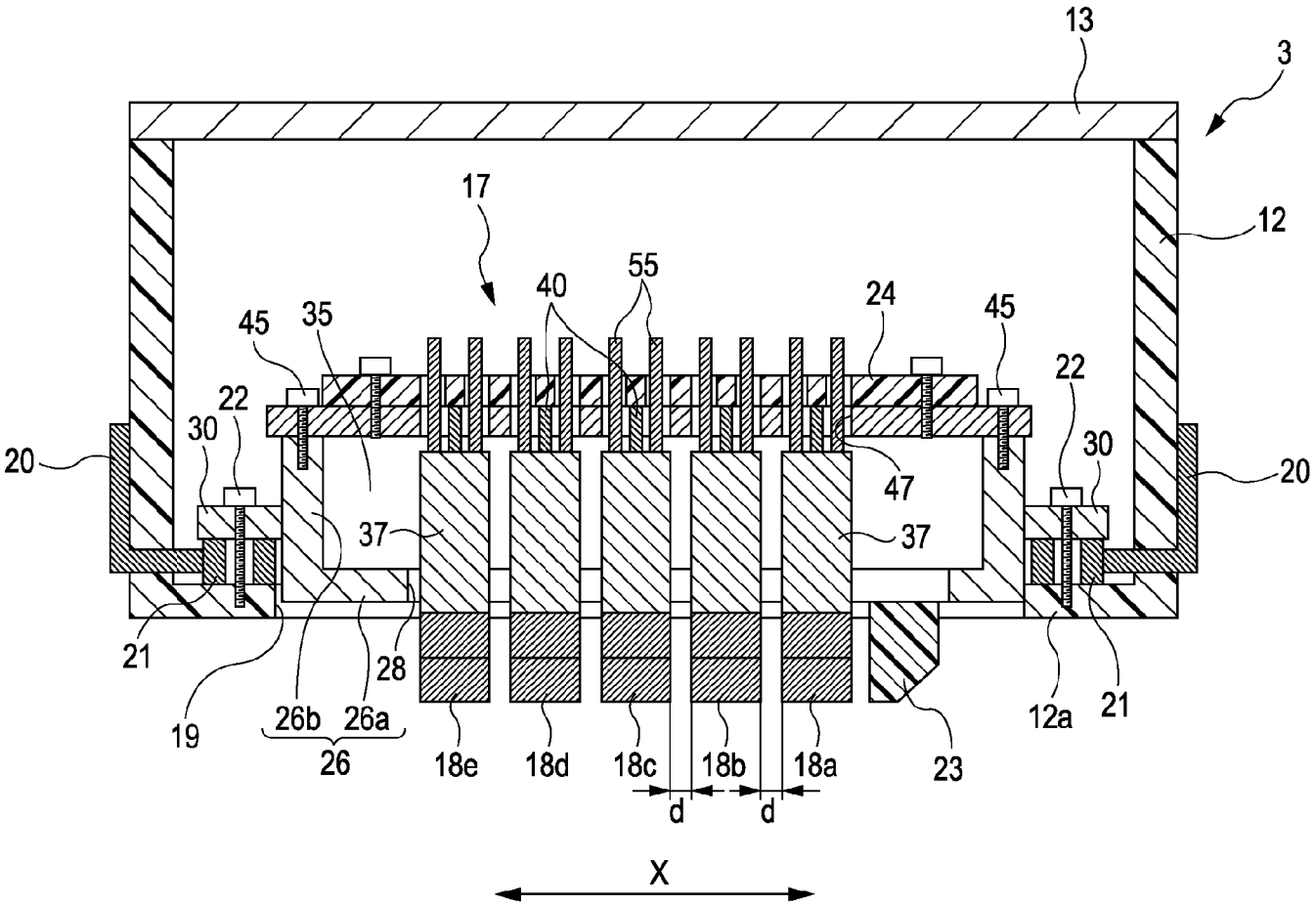
FIG. 15 is a sectional view that illustrates the structure of the carriage assembly in a more simplified way.

FIG. 10A is a perspective view of the head unit 17. Specifically, FIG. 10A illustrates a state in which a flow passage member 24 is attached as a part of the head unit 17. FIG. 10B is also a perspective view of the head unit 17. A state in which the flow passage member 24 has been detached therefrom is illustrated in FIG. 10B. FIG. 11 is a plan view (top view) of the head unit 17. FIG. 12 is a front view of the head unit 17. FIG. 13 is a bottom view of the head unit 17. FIG. 14 is a right side view of the head unit 17. FIG. 15 is a sectional view that illustrates the structure of the carriage assembly 3 in a more simplified way in order to facilitate the understanding of the present embodiment of the invention. Since FIG. 15 is a simplified diagram of the structure of the carriage assembly 3, the shape of each member, component, and the like and positional relationships therebetween in the illustration could be different from actual embodiments.

The head unit 17 is configured as an integrated unit of the plurality of recording heads 18 and the like. The head unit 17 includes a sub carriage 26 and the flow passage member 24. The sub carriage 26, which is an example of a head-fixing member according to an aspect of the invention, is a member to which the recording heads 18 are attached in a row, that is, next to one another. The sub carriage 26 is a hollow open-topped box-like member. Specifically, the sub carriage 26 includes a base plate portion 26*a* and sidewall portions 26*b*. The plurality of recording heads 18 is attached to the base plate portion 26*a*. Each of the sidewall portions 26*b* rises perpendicularly from the corresponding one of the four sides of the base plate portion 26*a*. A space that is enclosed by the base plate portion 26*a* and the sidewall portions 26*b* serves as a housing space 35 (refer to FIG. 15), which is a space in which at least a part of each of the plurality of recording heads 18 (mainly a sub tank 37) is housed. The sub carriage 26 according to the present embodiment of the invention is made of metal such as aluminum and thus has high rigidity. A head insertion opening 28 through which the plurality of recording heads 18 can be inserted (that is, a single opening that is shared by the plurality of recording heads 18) is formed at substantially the center of the base plate portion 26*a*. Therefore, the base plate portion 26*a* has a frame-like body. A plurality of fixing holes (female screws) 29 is formed in the lower surface (which is a surface that faces a recording target medium during recording operation) of the base plate portion 26*a* at positions corresponding to the attachment area of each of the plurality of recording heads 18 (refer to FIG. 12). Specifically, in the present embodiment of the invention, two fixing holes 29 are formed at each of two sides as viewed in a direction corresponding to the direction of a nozzle line at positions corresponding to the attachment holes of a spacer 32 for the attachment area of each of the plurality of recording heads 18 with the head insertion opening 28 formed between the two sides. In other words, the plurality of (i.e., four) fixing holes 29 is formed at four places respectively for the attachment area of each of the plurality of recording heads 18 (i.e., four female screws in total for one attachment area). The structure of each fixing hole 29 (i.e., the diameter of the screw hole, the depth thereof, and the thread pitch thereof) is the same as that of each fixing hole 41, which will be explained later, for common mechanical design.

The spacer 32 is a member that is made of synthetic resin. One spacer 32 is provided on the upper surface (which is a surface that is closer to the sub tank 37) of a flange portion 52*a* (refer to FIG. 16) at each of two sides for each of the plurality of recording heads 18. That is, two spacers 32 are provided for each of the plurality of recording heads 18. A head insertion hole (not shown) is formed at the center of the spacer 32 in its width direction, that is, in a direction orthogonal to the direction of a nozzle line. The head insertion hole corresponds to a spacer attachment hole 54 of the recording head 18. An attachment hole (not shown) is formed at each of two sides in the width direction of the spacer 32. The attachment hole corresponds to the fixing hole 29, which is formed in the sub carriage 26. That is, one head insertion hole and two attachment holes are formed in each of the plurality of spacers 32. In an assembly process before the attachment of the plurality of recording heads 18 to the sub carriage 26, the spacer 32 is screwed to the flange portion 52*a* at each of two sides of each of the plurality of recording heads 18. A spacer-fixing screw 27 is used for fixing the spacer 32 thereto.

As illustrated in, for example, FIG. 10, a flange portion 30 is formed on each of three of the (four) sidewall portions 26*b* of the sub carriage 26. The flange portions 30 extend sideward. An insertion hole 31 is formed through each of the three flange portions 30. The three insertion holes 31 correspond to threaded holes for attachment (not shown) that are formed at three places respectively at the position of the attachment of the head unit 17 to the bottom plate portion 12*a* of the carriage body 12. After the position alignment of each of the three insertion holes 31 with the corresponding one of the three attachment screw holes of the bottom plate portion 12*a* of the carriage body 12, a head-unit-fixing screw 22 is driven (screwed) into each of the three attachment screw holes through the corresponding one of the three insertion holes 31. In this way, the head unit 17 is fixed to the carriage body 12 in a state in which the head unit 17 is housed in the inner space of the carriage body 12. As explained earlier, in a manufacturing process before the non-provisional fixing of the head unit 17 to the carriage body 12, the plurality of levers 20 described earlier is operated so as to adjust the mount state of the head unit 17 housed in the space of the carriage body 12, such as the position of the head unit 17 and the inclination thereof, in relation to the carriage body 12. Screw holes 33 for fixing the flow passage member 24 are formed at four places in the upper surface of the sidewall portions 26*b* of the sub carriage 26.

The flow passage member 24 is a low-profile box-like member. For example, the flow passage member 24 is made of synthetic resin. A plurality of ink distribution flow passages (not shown) is formed inside the flow passage member 24 with a partition wall formed each therebetween. Each of the plurality of ink distribution flow passages corresponds to an ink color. In addition, each of the plurality of ink distribution flow passages corresponds to a flow passage connection portion (portions) 38 of the sub tank 37 (which will be described later) of the recording head 18. A tube connection portion 34 is formed on the upper surface of the flow passage member 24. As illustrated in FIG. 11, a plurality of inlet ports 39 each of which corresponds to an ink color is formed inside the tube connection portion 34. Each of the plurality of inlet ports 39 is in communication with the ink distribution flow passage of the corresponding ink color. The ink-supplying tube 14 described earlier has an inner ink-supplying passage for each ink color. When the ink-supplying tube 14 is connected to the tube connection portion 34, the ink-supplying passage for each ink color becomes in communication with the corresponding inlet port 39 in a liquid-tight state. As a result, ink of each color, which has been supplied from the ink-cartridge side through the ink-supplying tube 14, flows into the corresponding ink distribution flow passage in the flow passage member 24 through the corresponding inlet port 39. Flow-passage insertion holes (not shown) are formed at four corners of the flow passage member 24. The flow-passage insertion holes correspond to the screw holes 33 of the sub carriage 26. Each of the flow-passage insertion holes is a through hole that goes in the direction of plate thickness. To fix the flow passage member 24 to the sub carriage 26, a flow-passage-member-fixing screw 45 is driven (screwed) into each of the plurality of screw holes 33 through the corresponding flow-passage insertion hole.

As illustrated in FIGS. 12 and 15, a connection flow passage member 40, which extends downward, is provided on the lower surface of the flow passage member 24 at a position corresponding to the flow passage connection portion 38 of the sub tank 37 of each of the plurality of recording heads 18. Each of the plurality of connection flow passage members 40 is a hollow cylindrical member that has an inner outlet passage (not shown) with which the ink distribution flow passage of the corresponding ink color is in communication. The connection flow passage member 40 is inserted in the flow passage connection portion 38 of the sub tank 37 of each of the plurality of recording heads 18 for liquid-tight connection. Having flowed through the ink distribution flow passage in the flow passage member 24, ink is supplied to the sub tank 37 of the recording head 18 through the connection flow passage member 40 and the flow passage connection portion 38. In other words, the ink-supplying tube 14 is indirectly connected to the sub tanks 37 through the flow passage member 24, which is provided therebetween.

In the head unit 17 according to the present embodiment of the invention, as illustrated in FIG. 13, five recording heads 18 (18*a* to 18*e*) are attached to the base plate portion 26*a*, each as a detachable head, in such a manner that these recording heads 18 are arranged in a row with a predetermined gap (denoted as d in FIG. 15) each therebetween in the direction orthogonal to the direction of nozzle lines. The orthogonal direction mentioned above is the same as the main scan direction X and corresponds to a "direction in which . . . are arranged in a (the) row" according to an aspect of the invention. Accordingly, the orthogonal direction mentioned above is hereinafter referred to as "side-by-side-arrangement direction X". The five recording heads 18*a* to 18*e* are attached thereto in a state illustrated in FIG. 15, specifically, in the following way. The sub tanks 37 (described later) of the five recording heads 18*a* to 18*e* are inserted into the housing space 35 through the head insertion opening 28 from below. The spacers 32 (refer to FIG. 12) are interposed between the flanges of recording heads 18*a* to 18*e* and the base plate portion 26*a*. In this state, head-fixing screws (not shown) are driven into the fixing holes 29 through the attachment holes of the spacers 32. The head-fixing screw is an example of a head fixing means according to an aspect of the invention. Besides the five recording heads 18*a* to 18*e*, a head protection member 23 is attached to the base plate portion 26*a* outside the head row at a position next to the recording head 18 that is located at one end in the side-by-side-arrangement direction X (rightmost head in FIG. 15). The head protection member 23, which is an example of a protection member according to an aspect of the invention, is provided thereat for the purpose of protecting a side of the rightmost recording head 18. A more detailed explanation of the head protection member 23 will be given later. The structure of each of the head-fixing screws described above (i.e., its diameter, length, and thread pitch) is the same as that of each head-protection-member-fixing screw 42 for common mechanical design.

Figure 16:
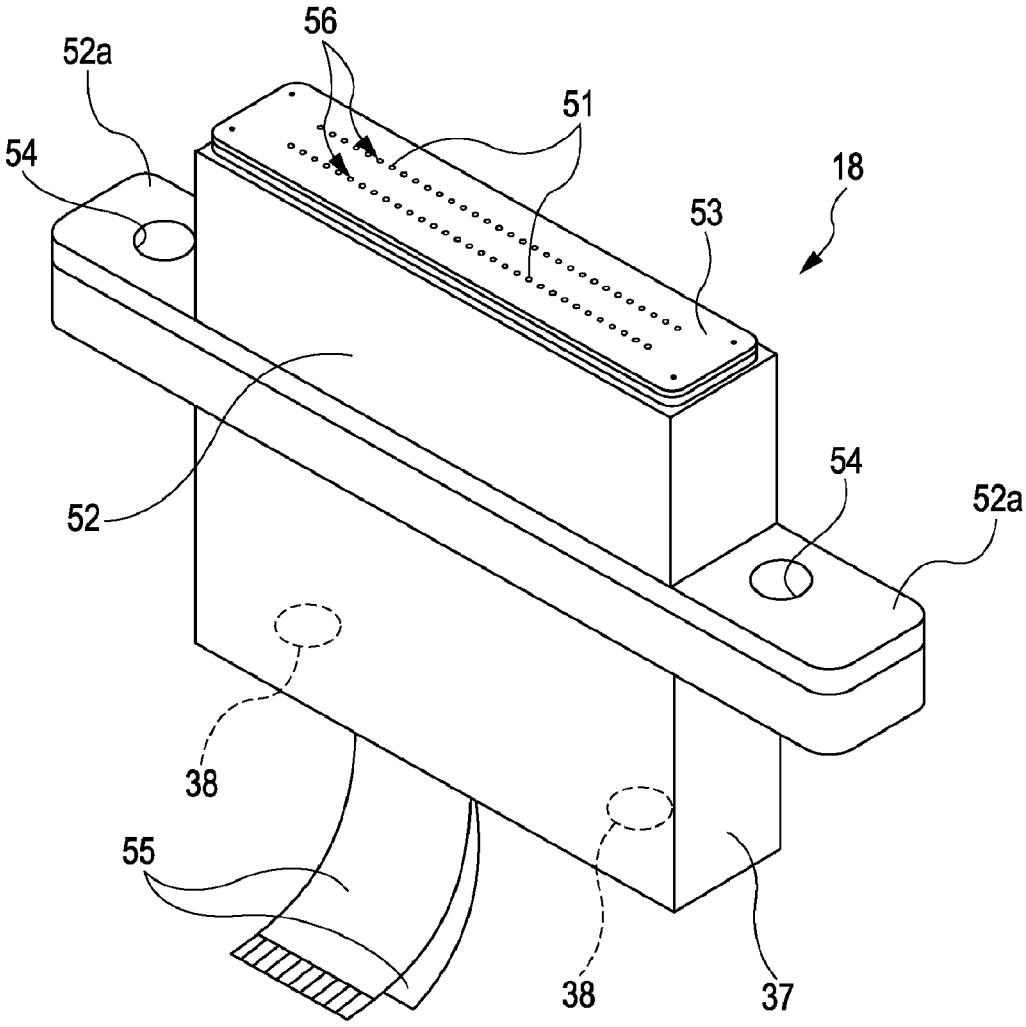
FIG. 16 is a perspective view of a recording head according to an exemplary embodiment of the invention.

FIG. 16 is a perspective view that schematically illustrates an example of the structure of the recording head 18, which is an example of a liquid ejecting head according to an aspect of the invention. Since the five recording heads 18, which can be attached to the sub carriage 26, have a common basic structure, one of them is shown in FIG. 16.

The recording head 18 has a head case 52. A flow passage unit (not shown) in which ink flow passages including pressure chambers that are in communication with nozzles 51 are formed and a pressure generating means (not shown) such as piezoelectric vibrators or heating elements for causing a pressure change in ink inside the pressure chambers are provided inside the head case 52. A driving signal is supplied from the control unit of the printer 1 to the pressure generating means so as to drive the pressure generating means. The recording head 18 is configured to eject ink from the nozzles 51 onto a recording target medium such as recording paper as a result of the driving of the pressure generating means. The nozzles 51 from which ink is ejected are formed in rows, that is, as nozzle lines 56 (a kind of nozzle groups), in the nozzle formation surface 53 of each of the plurality of recording heads 18. Two nozzle lines 56 are formed next to each other as viewed in the direction orthogonal to the nozzle-line direction. Each of the nozzle lines 56 is made up of 360 nozzle orifices that are formed at a pitch of, for example, 360 dpi. When the recording head 18 is in a standby state at the home position and is not being driven, in other words, when the recording head 18 is not performing the operation of printing an image, etc., on a recording target medium such as recording paper, a moisture retention cap 59 or a suction cap 60, which will be described later, covers the nozzle lines 56 for moisture retention. With such capping, the evaporation of an ink solvent through the nozzles 51 is suppressed. Therefore, it is possible to prevent the viscosity of ink from increasing.

The head case 52 is a hollow box-like member. The flow passage unit is fixed at the front-end side of the head case 52 with the nozzle formation surface 53 exposed to the outside. The pressure generating means and the like are housed in the inner space of the head case 52. The sub tank 37, from which ink is supplied to the flow passage unit, is attached to the base-surface side (the upper-surface side) of the head case 52. The base surface is a surface opposite to the nozzle formation surface 53. The flange portion 52*a* is formed at each of two sides in the nozzle-line direction at the upper-surface side of the head case 52. Each of the two flange portions 52*a* extends sideward. The spacer attachment hole 54, which corresponds to the aforementioned head insertion hole of the spacer 32, is formed through each of the two flange portions 52*a*. The spacer-fixing screw 27 is driven into the spacer attachment hole 54 when the spacer 32 is fixed to the flange portion 52*a*.

The sub tank 37 is a member through which ink flowing in from the flow passage member 24 can be supplied toward the pressure chambers of the recording head 18. The sub tank 37 has a self-sealing function for controlling the flow of ink into the pressure chambers by opening and closing its valve depending a change in inner pressure. The flow passage connection portion 38, to which the connection flow passage 40 of the flow passage member 24 is connected, is provided at both end regions in the nozzle-line direction in the rear-end surface (the upper surface) of the sub tank 37. A ring-shaped gasket (not shown) is fitted in the flow passage connection portion 38. The gasket ensures the liquid-tight connection of the connection flow passage 40 to the flow passage connection portion 38. Two driving substrates (not shown) are provided inside the sub tank 37. The driving substrates supply driving signals to the pressure generating means. A flexible cable 55 (wiring member) is electrically connected to each of the two driving substrates. The two flexible cables 55 are wired with exposure at the rear-end-surface side of the sub tank 37. The flexible cables 55 are connected to the signal cable 15. The driving signals, etc., sent through the signal cable 15 from the control unit of the printer 1 flow through the flexible cables 55 to be supplied to the pressure generating means via the driving substrates.

The head protection member 23 is a member that protects the recording head 18 (in particular, a side of the recording head 18 that is located at an end in the side-by-side-arrangement direction X) from, for example, recording paper during recording operation. For example, the head protection member 23 is made of synthetic resin. In the present embodiment of the invention, a single head protection member 23 is detachably attached (screwed) to the base plate portion 26*a* next to the rightmost recording head 18 in the side-by-side-arrangement direction X. That is, the head protection member 23 is located outside the row of the recording heads 18 attached to the sub carriage 26 next to the recording head 18*a*, which is located at the right end in the side-by-side-arrangement direction X. There is a gap d, which is the same as the aforementioned gap d between each two recording heads 18, between the head protection member 23 attached to the base plate portion 26*a* and the recording head 18 located next to the head protection member 23 (in the present embodiment of the invention, the recording head 18*a*, which is located at the right end in the side-by-side-arrangement direction X). The gap d is set at a value that is small enough (for example, approximately 0.2 mm or shorter) so that recording paper (for example, 0.3 mm) or the like cannot get into it. That is, the plurality of recording heads 18 and the head protection member 23 are arranged at equal spaces, meaning that the clearance between the head protection member 23 and the recording head 18*a* is the same as the clearance between each two recording heads 18 attached to the sub carriage 26.

In addition, as illustrated in FIG. 13, the dimensions of the head protection member 23 in a plan view (i.e., depth in the nozzle-line direction and width in the direction orthogonal to the direction of a nozzle line) are approximately the same as those of the recording head 18. The aforementioned plurality of fixing holes 41 is formed in the lower surface of the base plate portion 26*a* at positions corresponding to the attachment area of the head protection member 23. Specifically, in the present embodiment of the invention, two fixing holes 41 are formed at each of two sides as viewed in a direction corresponding to the direction of a nozzle line for the attachment area of the head protection member 23 with the head insertion opening 28 formed between the two sides. In other words, the plurality of (i.e., four) fixing holes 41 is formed at four places respectively for the attachment area of the head protection member 23. The aforementioned head-protection-member-fixing screws 42 are driven into the fixing holes 41 respectively to fix the head protection member 23. As explained earlier, the structure of each fixing hole 41 is the same as that of each fixing hole 29 for common mechanical design. A relationship between the positions of the fixing holes 41 relative to the position of the attachment of the head protection member 23 is the same as a relationship between the positions of the fixing holes 29 relative to the position of the attachment of the recording head 18. For this reason, the position of the attachment of the head protection member 23 is not limited to the outside of the row of the recording heads 18 attached to the base plate portion 26*a* (sub carriage 26) next to the recording head 18*a*, which is located at the right end in the side-by-side-arrangement direction X. The head protection member 23 can be detachably attached at the position of any of the recording heads 18. In other words, since the fixing holes 29 and the fixing holes 41 share a common structure, and since the head-fixing screws and the head-protection-member-fixing screws 42 share a common structure, it is possible to attach the head protection member 23 to the base plate portion 26*a* by placing the head protection member 23 at an unoccupied position of the recording head 18 and driving the head-protection-member-fixing screws 42 into the fixing holes 29 respectively. The head protection member 23 can be detached from the attachment position by unscrewing the head-protection-member-fixing screws 42.

As illustrated in FIGS. 15, 17A, 17B, and 17C, the head protection member 23 has an inclined plane 23*c* at a front-end portion 23*a*, which is a part opposite to a sub-carriage-attachment-side part and faces a recording target medium during recording operation. The inclined plane 23*c* is sloped up from the head side (18*a*) toward the opposite side, that is, outward, with respect to the side-by-side-arrangement direction X. In other words, the inclined plane 23*c* is formed as a slope that is continuous from a front-end surface 23*b*, which is a surface of the front-end portion 23*a* of the head protection member 23 that is parallel with the nozzle formation surface 53, to a side of the head protection member 23 away from the plurality of recording heads 18, which means that it is formed by obliquely cutting off a corner of the front-end portion 23*a* that is not closer to the plurality of recording heads 18 or as if the corner has been cut off obliquely. The front-end surface 23*b* of the front-end portion 23*a* is located at a position that is not closer to the sub carriage 26 in comparison with the nozzle formation surface 53 of each of the plurality of recording heads 18 attached to the sub carriage 26. Because of such a structure, it is possible to protect the adjacent recording head 18 against shock due to collision with recording paper or the like, thereby preventing the aligned recording head 18 from becoming misaligned with respect to the sub carriage 26. As an example of a modified structure, the front-end surface 23*b* of the front-end portion 23*a* may be level with the nozzle formation surface 53 of each of the plurality of recording heads 18 attached to the sub carriage 26. The gist is that the head protection member 23 can shield a side of the recording head 18 for protection.

A part of the inclination 23*c* is dented as a recess 23*d* toward the sub carriage 26. In the present embodiment of the invention, two slope regions of the plane 23*c* are formed at respective ends of the head protection member 23 in the direction orthogonal to the side-by-side-arrangement direction X. The recess 23*d* is formed between the two slope regions of the plane 23*c* (at the center). The opening size L1 of the recess 23*d* in the direction orthogonal to the side-by-side-arrangement direction X is smaller (narrower) than the size of the head protection member 23 in this direction and larger (wider) than the size of the moisture retention cap 59 or the suction cap 60 in this direction. For example, in the direction orthogonal to the side-by-side-arrangement direction X, the head protection member 23, the recess 23*d*, and the moisture retention cap 59 or the suction cap 60 have the size (width) of 61.7 mm, 59.7 mm, and 56.0 mm, respectively.

Figure 17A:
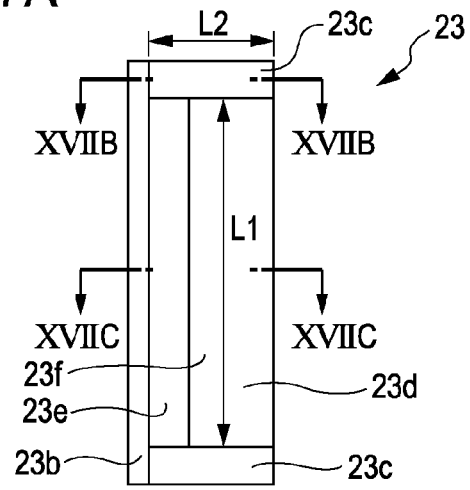
FIG. 17A is a bottom view of a head protection member according to an exemplary embodiment of the invention.
Figure 17B:
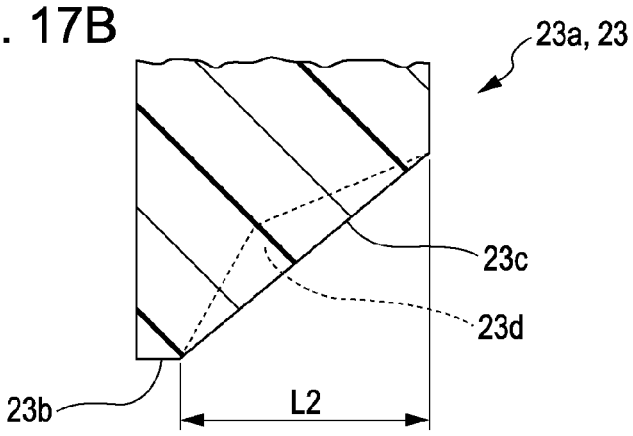
FIG. 17B is a close-up sectional view taken along the line XVIIB-XVIIB of FIG. 17A.
Figure 17C:
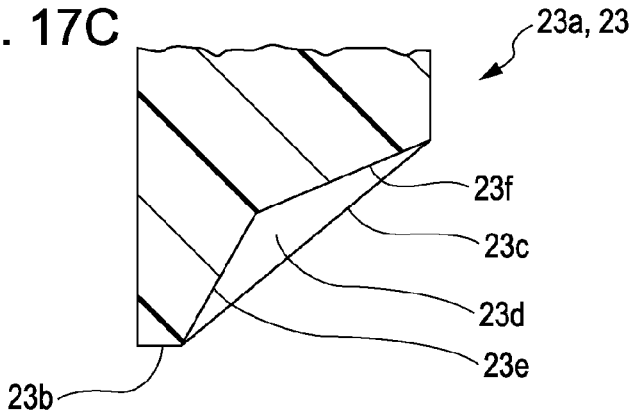
FIG. 17C is a close-up sectional view taken along the line XVIIC-XVIIC of FIG. 17A.
Figure 18A:
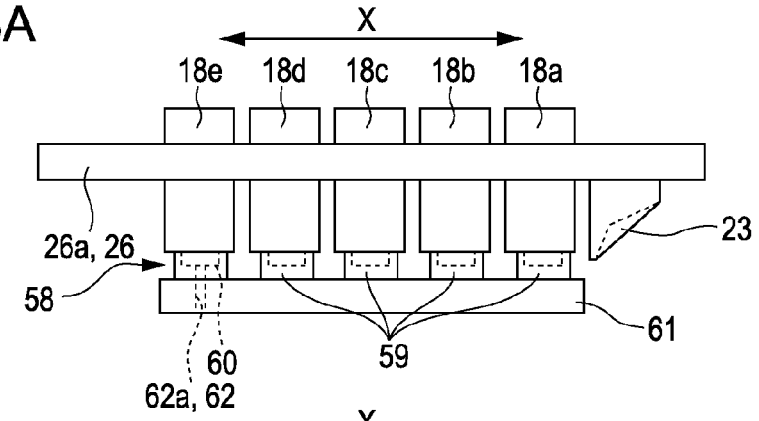
FIG. 18A is a side view of the head unit and a cap group according to an exemplary embodiment of the invention; specifically, a state in which the cap group is in contact with each recording head is illustrated therein.
Figure 18B:
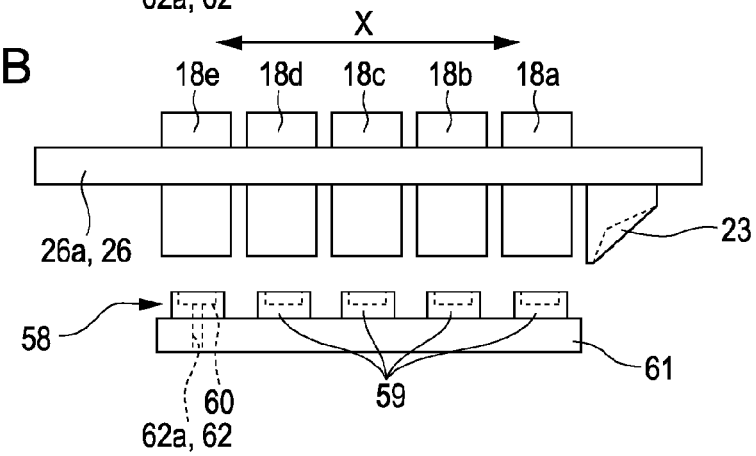
FIG. 18B is a side view of the head unit and the cap group; specifically, a state in which the cap group is not in contact with each recording head is illustrated therein.
Figure 18C:
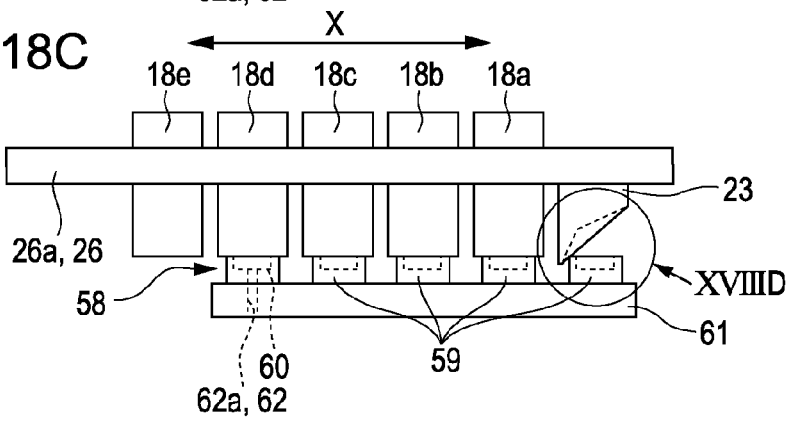
FIG. 18C is a side view of the head unit and the cap group; specifically, a state in which the cap group is in contact with the recording heads after movement in a horizontal direction is illustrated therein.
Figure 18D:
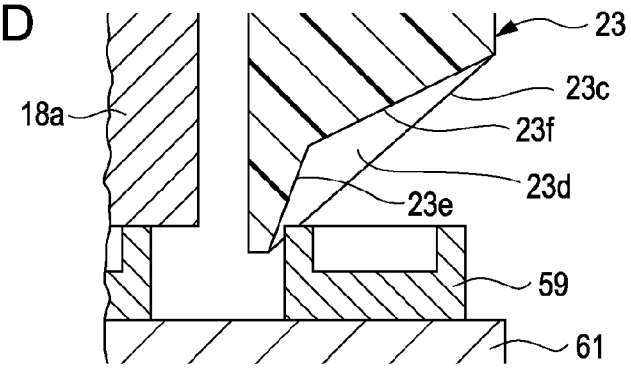
FIG. 18D is a close-up sectional view of the head unit and the cap group; specifically, a part XVIIID is illustrated therein in an enlarged view.

When projected vertically as a size in the side-by-side-arrangement direction X, the opening size L2 of the recess 23*d* is the same as the projected size of the inclined plane 23*c* in this direction. As is evident from the above, each of the two slope regions of the plane 23*c* according to the present embodiment of the invention is formed as an inclined surface of the front-end portion 23*a* of the head protection member 23 with the recess 23*d* formed therebetween. The recess 23*d* is made up of a first recess inclined plane 23*e* and a second recess inclined plane 23*f* that have angles of inclination different from each other. The first recess inclined plane 23*e* is an inner part that is located closer to the plurality of recording heads 18 than the second recess inclined plane 23*f* in the side-by-side-arrangement direction X. The first recess inclined plane 23*e* is steeper than the inclined plane 23*c* with respect to a plane that is parallel with the nozzle formation surface 53. For example, the angle of inclination of the inclined plane 23*c* with respect to a plane that is parallel with the nozzle formation surface 53 is 23.3°. The angle of inclination of the first recess inclined plane 23*e* with respect thereto is 55.0°. The first recess inclined plane 23*e* is continuous at its lower end from the front-end surface 23*b*. At its upper end, the first recess inclined plane 23*e* is continuous to the lower end of the second recess inclined plane 23*f*. The second recess inclined plane 23*f* is an outer part that is located outside the first recess inclined plane 23*e* in the side-by-side-arrangement direction X. The second recess inclined plane 23*f* is gentler than the inclined plane 23*c* with respect to a plane that is parallel with the nozzle formation surface 53. For example, the angle of inclination of the second recess inclined plane 23*f* with respect to a plane that is parallel with the nozzle formation surface 53 is 12.4°. The second recess inclined plane 23*f* is continuous at its lower end from the upper end of the first recess inclined plane 23*e*. At its upper end, the second recess inclined plane 23*f* is continuous to a side face of the head protection member 23. That is, as illustrated in FIG. 17C, in a front cross-sectional view taken in the side-by-side-arrangement direction X, the recess 23*d* is formed as a triangular cavity inside the inclined plane 23*c*.

Next, the aforementioned plurality of capping members (hereinafter referred to as "cap group 58") will now be explained. The cap group 58 is provided under the carriage assembly 3 on standby at the home position. The cap group 58 includes a plurality of caps for covering the nozzles 51 formed in the surface regions 53 of the plurality of recording heads 18 so as to keep them in a sealed state. The number of the caps is the same as that of the recording heads 18 of the head unit 17. The caps are arranged in the side-by-side-arrangement direction X with the same gap each therebetween as the gap of the recording heads 18 each therebetween. In the present embodiment of the invention, one cap in the cap group 58 is the suction cap 60, which makes it possible to suck ink out of the nozzles 51 in a state in which the nozzle formation surface 53 is capped. Each of the other caps is the moisture retention cap 59, which does not have such a suction-capping function. Each of the caps 59 and 60 is an open-topped tray-like member that resembles a letter "U" in a cross section. The top of the sidewalls of the cap can be brought into contact with the nozzle formation surface 53 of the recording head 18. Each of these caps is made of an elastic resin material such as elastomer or the like. These caps have the same dimensions and shape. The outer edge of the top of the sidewalls of each of the caps 59 and 60 is rounded (or tapered). When in a capping state, the moisture retention cap 59 prevents the viscosity of ink in the neighborhood of the nozzles 51 from increasing due to drying. The capping state is a state in which the top of the sidewalls of the cap is in contact with the nozzle formation surface 53 of the recording head 18 located at the home position to cover the nozzles 51 (the nozzle lines 56). In other words, the moisture retention cap 59 has a function of keeping ink moisturized in the neighborhood of the nozzles 51. The suction cap 60 also prevents the viscosity of ink in the neighborhood of the nozzles 51 from increasing due to drying when in a state in which the top of the sidewalls thereof is in contact with the nozzle formation surface 53 of the recording head 18 located at the home position to cover the nozzles 51 (the nozzle lines 56). Being equipped with a sucking means 62, the suction cap 60 has a function of sucking ink out of the nozzles 51 by using a suction force generated by a pump (not shown) in addition to the moisture retention function described above. In this respect, the suction cap 60 is different from the moisture retention cap 59. The sucking means 62 includes a communication passage 62*a*, a tube (not shown), the pump, and the like. One end of the communication passage 62*a* is open toward the opening of the suction cap 60. The other end of the communication passage 62*a* is open at the lower surface of a cap-supporting member 61, which will be described later. The tube is connected to the other end of the communication passage 62*a* at the lower surface of the cap-supporting member 61 for liquid-tight communication. In a state in which the suction cap 60 is in contact with the nozzle formation surface 53 of the recording head 18 for capping (sealing) it, the pump makes the internal pressure of the space sealed by the suction cap 60 negative by applying a suction force thereto through the tube and the communication passage 62*a*. That is, the suction cap 60 is capable of not only sealing the nozzles 51 of the recording head 18 that is not being driven for moisture retention but also sucking ink out of the nozzles 51 by using the sucking means 62 in suction operation performed when, for example, the recording head 18 has not been driven for a long time or when the inner flow passages of the recording head 18 are filled with ink at the time of ink-cartridge replacement.

As illustrated in FIG. 18 (in particular, refer to FIGS. 18A, 18B, and 18C), the cap group 58 according to the present embodiment of the invention is made up of four moisture retention caps 59 and one suction cap 60. The suction cap 60 is located at the other end in the side-by-side-arrangement direction X (left end in FIG. 18). To cap the nozzle formation surface 53 of each of the five recording heads 18*a* to 18*e* that are located at the home position, the recording head 18*e*, which is located at the other end in the side-by-side-arrangement direction X, that is, the end opposite to the one end where the recording head 18*a* is provided next to the head protection member 23, which is provided outside the head row, is positioned to face the suction cap 60. Accordingly, the remaining four recording heads, 18*a*, 18*b*, 18*c*, and 18*d*, are positioned to face the four moisture retention caps 59, respectively. The above position of the cap group 58 relative to the positions of the recording heads 18*a* to 18*e* in the side-by-side-arrangement direction X is hereinafter referred to as "reference position".

The cap-supporting member 61 supports the cap group 58. The cap-supporting member 61 moves up and down when driven by an elevation mechanism (not shown). The cap-supporting member 61 is set in a lower position or moved to the lower position when the cap group 58 is not used for performing capping/suction operation for the plurality of recording heads 18. In this state, the moisture retention caps 59 and the suction cap 60 are away from the nozzle formation surface 53 thereof (first state). To perform capping/suction operation for the recording head(s) 18, the cap-supporting member 61 is lifted so as to bring the moisture retention cap(s) 59/suction cap 60 into contact with the recording head(s) 18 on standby at the home position (second state, capping/sucking state).

Next, suction operation that is performed when the printer 1 having the above structure has not been driven for a long time will now be explained. The cap group 58 is in a standby state at the reference position. Depending on the operation state of the recording heads 18, the cap group 58 is either in the first state, in which the moisture retention caps 59 and the suction cap 60 are away from the nozzle formation surface 53 thereof, or in the second state, in which the moisture retention caps 59 and the suction cap 60 are in contact with the nozzle formation surface 53 thereof. In the following description, a case where suction operation is started from the second state after the idling of the printer 1 for a long time is explained. Detecting that the printer 1 has not been driven for a predetermined length of time in the second state, the control unit of the printer 1 causes the suction pump to operate so as to suck ink out of the nozzles 51 of the suction target head, that is, the recording head 18*e*, with which the suction cap 60 is in contact (refer to FIG. 18A). After the completion of suction operation for the recording head 18*e*, the cap-supporting member 61 is moved down. This means that the cap group 58 is moved away from the recording heads 18*a* to 18*e*, that is, put into the first state (refer to FIG. 18B). In this state, the carriage assembly 3 is moved in parallel inward, that is, from the home position toward the full position, with respect to the side-by-side-arrangement direction X. The amount of the above movement of the carriage assembly 3, which is movement from the reference position, corresponds to the pitch of the recording heads 18 arranged in a row. As a result of such carriage movement by the head pitch, the suction cap 60 faces the next suction target head, that is, the recording head 18*d*. In addition, among the four moisture retention caps 59, one that is located at one end in the side-by-side-arrangement direction X faces the head protection member 23. Then, the cap-supporting member 61 is lifted from the shifted position to be put into the second state. Therefore, the three moisture retention caps 59 and the suction cap 60 are brought into contact with the edges of the surface regions 53 of the recording heads 18*a*, 18*b*, 18*c*, and 18*d*, respectively (refer to FIG. 18C). The remaining one moisture retention cap 59 is lifted toward the head protection member 23 in this process. A part of this moisture retention cap 59 enters the recess 23*d* of the head protection member 23, which is dented toward the sub carriage 26. The moisture retention cap 59 is not brought into contact with the head protection member 23 because the recess 23*d*, which is located above the front-end surface 23*b* and the inclined plane 23*c*, can accommodate the part of the moisture retention cap 59, which is allowed to escape into the recess 23*d* beyond the inclined plane 23*c* when the cap-supporting member 61 is lifted (refer to FIG. 18D). In this state, the suction cap 60 is in contact with the recording head 18*d*, the suction target head, for sucking ink out of the nozzles 51 thereof. The same operation as above is repeated for the remaining three recording heads, 18*c*, 18*b*, and 18*a*, to suck ink out of the nozzles 51 thereof by means of the suction cap 60. After the completion of suction operation for all of the recording heads 18*a* to 18*e*, the cap-supporting member 61 is moved down for transition to the first state. The carriage assembly 3 is thereafter moved toward the home position for return to the reference position. The cap-supporting member 61 is lifted again for return into the second state. Alternatively, the carriage assembly 3 is moved from the home position to a recording position (toward the full position) so as to start printing on a recording target medium. In the present embodiment of the invention, the carriage assembly 3 is moved in parallel with respect to the side-by-side-arrangement direction X. However, the scope of the invention is not limited to such an exemplary structure. For example, the cap-supporting member 61 may be equipped with a parallel movement mechanism for moving the cap group 58. The gist is that the relative position of the cap group 58 and the head group 18 of the head unit 17 can be shifted in parallel with respect to the side-by-side-arrangement direction X.

As explained above, in the structure of the printer 1 according to the present embodiment of the invention, a part of the inclination 23*c* is dented as the recess 23*d*. In a state in which the suction cap 60 is in contact with any recording head (18*a*, 18*b*, 18*c*, or 18*d*) other than the recording head 18*e*, which is one that is initially in contact with the suction cap 60 when it is in a standby state, more specifically, when one of the moisture retention caps 59 faces the head protection member 23 and, in addition, when each of the remaining moisture retention caps 59 (moisture retention cap(s) 59) as well as (or) the suction cap 60 is in contact with the nozzle formation surface 53 of the recording head 18 in the second state, a part of the moisture retention cap 59 (or the suction cap 60) facing the head protection member 23 is in the recess 23*d*, which ensures that the cap 59 (60) is not in contact with the head protection member 23. Therefore, the sticking of ink from the cap 59 (60) onto the head protection member 23 does not occur. This makes it possible to prevent the transferred ink from dripping from the head protection member 23 onto recording paper, etc. and prevent recording paper, etc., from becoming stained by the transferred ink even when the collision of the recording paper with the head protection member 23 occurs. Moreover, since the head protection member 23 has the inclined plane 23*c*, when recording paper, etc., that is transported toward the head unit 17 from a side in the side-by-side-arrangement direction X collides with the inclined plane 23*c*, the head protection member 23 can guide the recording paper away from the sub carriage 26 along its inclined plane 23*c*, thereby lessening the impact of the collision. That is, in addition to its structure for avoiding contact with a cap at the time of capping operation, the head protection member 23 has a function of protecting the recording head 18. Since the head protection member 23 has a contact-avoiding function, the structure described in the above embodiment of the invention can be adopted; a sucking means is provided in at least one cap in the cap group 58; suction operation can be performed for all of the recording heads 18 sequentially through the relative movement of the recording heads 18 and the cap group 58. That is, it is not necessary to provide the sucking means 62 as an individual sucking device for each of caps corresponding to the recording heads 18 even if a structure in which suction operation is performed for all of the recording heads 18 is adopted. The disclosed structure is advantageous because of simplicity. Furthermore, since the recess 23*d* of the head protection member 23 is made up of the first recess inclined plane 23*e* and the second recess inclined plane 23*f*, which are inclined in the same orientation as the orientation of the inclined plane 23*c* with different angles of inclination, even when recording paper, etc, gets into the recess 23*d*, the head protection member 23 can guide the recording paper downward along the second recess inclined plane 23*f* and the first recess inclined plane 23*e*, thereby lessening the impact of the collision.

Figure 19:
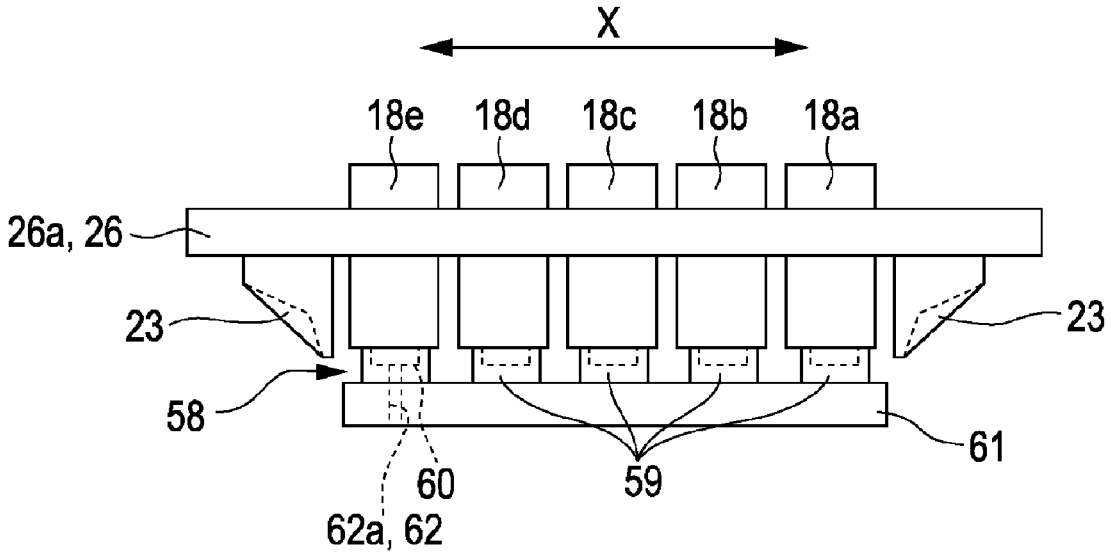
FIG. 19 is a side view of a head unit and a cap group according to another embodiment of the invention.

The scope of the invention is not limited to the first embodiment described above. The invention may be modified, altered, changed, adapted, and/or improved without departing from the gist and/or spirit thereof apprehended by a person skilled in the art from explicit and implicit description given herein. Such a modification and the like are also encompassed within the scope of the appended claims. For example, in a second embodiment of the invention, the head protection member 23 is provided at each of two sides in the side-by-side-arrangement direction X as illustrated in FIG. 19. The recording heads 18*a* to 18*e* are arranged between the two head protection members 23.

More specifically, in the second embodiment of the invention, one of the two head protection members 23 is located outside the row of the recording heads 18 next to the recording head 18*a*, which is located at the right end in the side-by-side-arrangement direction X, whereas the other of the two head protection members 23 is located outside the row of the recording heads 18 next to the recording head 18*e*, which is located at the left end in the side-by-side-arrangement direction X. As in the first embodiment of the invention, each of the two head protection members 23 according to the second embodiment of the invention has the inclined plane 23*c* at the front-end portion 23*a*, which is a part opposite to a sub-carriage-attachment-side part and faces a recording target medium during recording operation. The inclined plane 23*c* is sloped up from the head side (18*a*, 18*e*) toward the opposite side, that is, outward, with respect to the side-by-side-arrangement direction X. Moreover, as in the first embodiment of the invention, the recess 23*d* is made up of the first recess inclined plane 23*e* and the second recess inclined plane 23*f*, which have angles of inclination different from each other. That is, as illustrated in FIG. 19, the two head protection members 23 are provided symmetrically with the recording heads 18 arranged therebetween. With such a dual structure, it is possible to protect the recording heads 18 of the head unit 17 at both sides from recording paper, etc. that is transported during recording operation. Since the structure according to the second embodiment of the invention is the same as the structure according to the first embodiment of the invention except for the above point, an explanation thereof is not given here.

In the foregoing embodiments of the invention, a single suction cap 60 is provided. However, the scope of the invention is not limited to such an exemplary structure. Two or more suction caps 60 may be provided. The gist is that at least one of the caps constituting the cap group 58 is the suction cap 60. In the foregoing embodiments of the invention, the head protection member(s) 23 is detachably attached to the base plate portion 26*a* of the sub carriage 26 by using screws. As a modification example, the head protection member(s) 23 may be molded as a part of the base plate portion 26*a* of the sub carriage 26. In the foregoing embodiments of the invention, a structure for ejecting ink onto recording paper while reciprocating the plurality of recording heads 18 is taken as an example. However, the scope of the invention is not limited to such an exemplary structure. For example, a structure for ejecting ink from a plurality of fixed recording heads 18 onto recording paper while moving the recording paper can be adopted.

In the foregoing embodiments of the invention, the printer 1 is taken as an example of a liquid ejecting apparatus according to an aspect of the invention. Notwithstanding the foregoing, however, the invention can be applied to various liquid ejecting apparatuses. For example, the invention can be applied to, without any limitation thereto: a display manufacturing apparatus for the production of a color filter for a liquid crystal display or the like; an electrode manufacturing apparatus that is used for the electrode formation of an organic electroluminescence (EL) display, a surface/plane emission display (FED), and the like; and a chip manufacturing apparatus that is used for the production of biochips.

What is claimed is:

1. A liquid ejecting apparatus comprising:

a liquid ejecting head unit that includes a head-fixing member to which a plurality of liquid ejecting heads is attached in a row, each of the plurality of liquid ejecting heads having a nozzle surface and being capable of ejecting liquid toward a liquid ejection target medium from nozzles that are formed in the nozzle surface;

a protection member that is located outside the row of the liquid ejecting heads adjacent to a liquid ejecting head included in the liquid ejecting heads, the liquid ejecting head being located at an end in a direction in which the liquid ejecting heads are arranged in the row, the direction being hereinafter referred to as side-by-side-arrangement direction, the protection member being provided thereat for protecting a side of the adjacent liquid ejecting head; and a cap group that is made up of a plurality of caps for covering the nozzles, the number of the caps being the same as that of the liquid ejecting heads of the liquid ejecting head unit, the caps being arranged in the side-by-side-arrangement direction with the same gap each therebetween as the gap of the liquid ejecting heads each therebetween, wherein a relative position of the cap group and the liquid ejecting heads of the liquid ejecting head unit can be shifted in parallel with respect to the side-by-side-arrangement direction, a state of the cap group can be changed into a state in which a cap included in the cap group is in contact with the nozzle surface;

the protection member has an inclined plane at a front-end portion, the inclined plane being sloped up from a liquid-ejecting-head side toward the opposite side, that is, outward, with respect to the side-by-side-arrangement direction, a recess is formed at a part of the inclined plane, and in a state in which one of the caps faces the protection member and, in addition, each of the remaining caps is in contact with the nozzle surface of the liquid ejecting head, a part of the cap facing the protection member is in the recess, which ensures that the cap is not in contact with the protection member.

2. The liquid ejecting apparatus according to claim 1, wherein the recess includes a first recess inclined plane that is steeper than the inclined plane with respect to a plane that is parallel with the nozzle surface and a second recess inclined plane that is gentler than the inclined plane with respect to the plane that is parallel with the nozzle surface.

3. The liquid ejecting apparatus according to claim 1, further comprising a sucking section, wherein at least one of the plurality of caps that make up the cap group can suck liquid out of the nozzles formed in the nozzle surface by using a suction force of the sucking section in a state in which the at least one cap is in contact with the nozzle surface.

* * * * *